US011193437B2

(12) United States Patent
Uchida et al.

(10) Patent No.: US 11,193,437 B2
(45) Date of Patent: Dec. 7, 2021

(54) EVAPORATIVE FUEL PROCESSING DEVICE

(71) Applicant: HAMANAKODENSO CO., LTD., Kosai (JP)

(72) Inventors: Kimio Uchida, Kariya (JP); Hirofumi Onodera, Kariya (JP)

(73) Assignee: HAMANAKODENSO CO., LTD., Kosai (JP)

( * ) Notice: Subject to any disclaimer, the term of this patent is extended or adjusted under 35 U.S.C. 154(b) by 0 days.

(21) Appl. No.: 17/160,673

(22) Filed: Jan. 28, 2021

(65) Prior Publication Data

US 2021/0239057 A1 Aug. 5, 2021

(30) Foreign Application Priority Data

Jan. 30, 2020 (JP) ..... JP2020-014102

(51) Int. Cl.

| | |
|---|---|
| ***F02D 41/00*** | (2006.01) |
| ***F02M 35/10*** | (2006.01) |
| ***F02M 25/08*** | (2006.01) |
| ***F02D 41/24*** | (2006.01) |
| ***F02D 41/22*** | (2006.01) |

(52) U.S. Cl.

CPC ..... *F02D 41/004* (2013.01); *F02D 41/22* (2013.01); *F02D 41/2438* (2013.01); *F02M 25/089* (2013.01); *F02M 25/0809* (2013.01); *F02M 25/0836* (2013.01); *F02M 35/10222* (2013.01);

(Continued)

(58) Field of Classification Search

CPC .... F02D 41/004; F02D 41/2438; F02D 41/22; F02D 2041/225; F02D 2200/0602; F02M 35/10222; F02M 25/0836; F02M 25/089; F02M 25/0809

See application file for complete search history.

(56) References Cited

U.S. PATENT DOCUMENTS

| | | | | |
|---|---|---|---|---|
| 10,267,248 | B2 * | 4/2019 | Kimoto | F02M 25/0836 |
| 2015/0159598 | A1 * | 6/2015 | Tagawa | F02M 25/0854 123/520 |

(Continued)

OTHER PUBLICATIONS

U.S. Appl. No. 17/160,682, to Uchida, et al., entitled "Evaporative Fuel Processing Device", filed Jan. 28, 2021 (52 pages).

(Continued)

*Primary Examiner* — Xiao En Mo

(74) *Attorney, Agent, or Firm* — Nixon & Vanderhye P.C.

(57) ABSTRACT

A control device transmits an opening degree command amount to an actuator to command an opening degree of a sealing valve. The control device sets a pressure difference between a tank-side pressure and a canister-side pressure to a specified value or more. The control device causes a pressure variable device to change the canister-side pressure to form a state in which the pressure difference becomes equal to or higher than a specified value while the sealing valve is closed. The control device learns a valve opening start amount based on the opening degree command amount when the tank-side pressure changes in response to the opening degree command amount that gradually increases from zero. The control device determines the opening degree command amount based on the valve opening start amount, which has been learned.

9 Claims, 15 Drawing Sheets

(52) U.S. Cl.
CPC ..... *F02D 2041/225* (2013.01); *F02D 2200/0602* (2013.01)

(56) References Cited

U.S. PATENT DOCUMENTS

| | | | | |
|---|---|---|---|---|
| 2017/0284317 | A1 | 10/2017 | Kimoto et al. | |
| 2017/0284321 | A1* | 10/2017 | Kimoto | F02M 25/0836 |
| 2018/0264937 | A1* | 9/2018 | Fukui | F02M 25/0872 |
| 2019/0032613 | A1 | 1/2019 | Miyabe et al. | |
| 2019/0376475 | A1* | 12/2019 | Fukui | F02M 25/0836 |
| 2021/0239066 | A1* | 8/2021 | Uchida | F02D 41/003 |

OTHER PUBLICATIONS

U.S. Appl. No. 17/160,682, filed Jan. 28, 2021, Evaporative Fuel Processing Device.

* cited by examiner

EVAPORATIVE FUEL PROCESSING DEVICE

CROSS REFERENCE TO RELATED APPLICATION

The present application claims the benefit of priority from Japanese Patent Application No. 2020-14102 filed on Jan. 30, 2020. The entire disclosures of all of the above applications are incorporated herein by reference.

TECHNICAL FIELD

The present disclosure relates to an evaporative fuel processing device provided in a vehicle.

BACKGROUND

In a vehicle having an internal combustion engine, liquid fuel is stored in a fuel tank and is to be used for the internal combustion engine. The gas in the fuel tank exerts pressure such as vapor pressure of the evaporated fuel according to the temperature. When refueling the fuel tank, in order not to release the evaporated fuel to the outside, an evaporative fuel processing device having a canister configured to adsorb the evaporated fuel is used.

SUMMARY

According to an aspect of the present disclosure, an evaporated fuel processing device is provided in a vehicle, which includes an internal combustion engine and a fuel tank, for processing evaporated fuel that is fuel evaporated in the fuel tank. The evaporated fuel processing device comprises a canister including an adsorbent for adsorbing evaporated fuel. The evaporated fuel processing device further comprises a sealing valve provided in a vapor pipe that connects the fuel tank to the canister, the sealing valve configured to be operated by an actuator to quantitatively adjust an opening degree of the sealing valve to open and close the vapor pipe. The evaporated fuel processing device further comprises a tank pressure sensor provided in the fuel tank and configured to detect a tank-side pressure that is a pressure of vapor-phase phase gas in the fuel tank. The evaporated fuel processing device further comprises a purge valve provided in a purge pipe that connects the canister to an intake pipe of the internal combustion engine, the purge valve configured to open and close the purge pipe. The evaporated fuel processing device further comprises a control device configured to selectively execute each of a sealing operation to cause the sealing valve to close the vapor pipe to seal the fuel tank, a vapor operation to cause the sealing valve to open the vapor pipe to purge the vapor-phase gas in the fuel tank into the canister, a canister purge operation to cause the purge valve to open the purge pipe to purge a fuel component in the canister into the intake pipe, a purge operation to cause the sealing valve to open the vapor pipe and at the same time to cause the purge valve to open the purge pipe to purge the vapor-phase gas in the fuel tank into the intake pipe by bypassing the canister, and a learning operation to learn an opening degree of the sealing valve when the vapor pipe is opened. The evaporated fuel processing device further comprises an open/close valve configured to open and close a pressure release port that is configured to open the canister to an atmosphere. The evaporated fuel processing device further comprises a pressure variable device provided to the canister and configured to operate, while the open/close valve is closed, to variably adjust a canister-side pressure that is a pressure in the vapor pipe on a side of the canister with respect to the sealing valve. The control device includes an opening degree command unit configured to transmit an opening degree command amount, which is for determining the opening degree of the sealing valve, to the actuator, a valve opening start learning unit configured to set a pressure difference between the tank-side pressure and the canister-side pressure to a specified value or more before opening the vapor pipe in the learning operation and learn a valve opening start amount based on the opening degree command amount when the tank-side pressure changes in response to the opening degree command amount that gradually increases from zero, and a pressure difference forming unit configured to cause the pressure variable device to change the canister-side pressure and control opening and closing of the open/close valve and the sealing valve to form a state in which the pressure difference becomes equal to or higher than a specified value in a state in which the sealing valve is closed. The control device is configured to determine the opening degree command amount of the opening degree command unit based on the valve opening start amount, which has been learned, when causing the sealing valve to open to perform the vapor operation or the purge operation.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION

Figure 1:
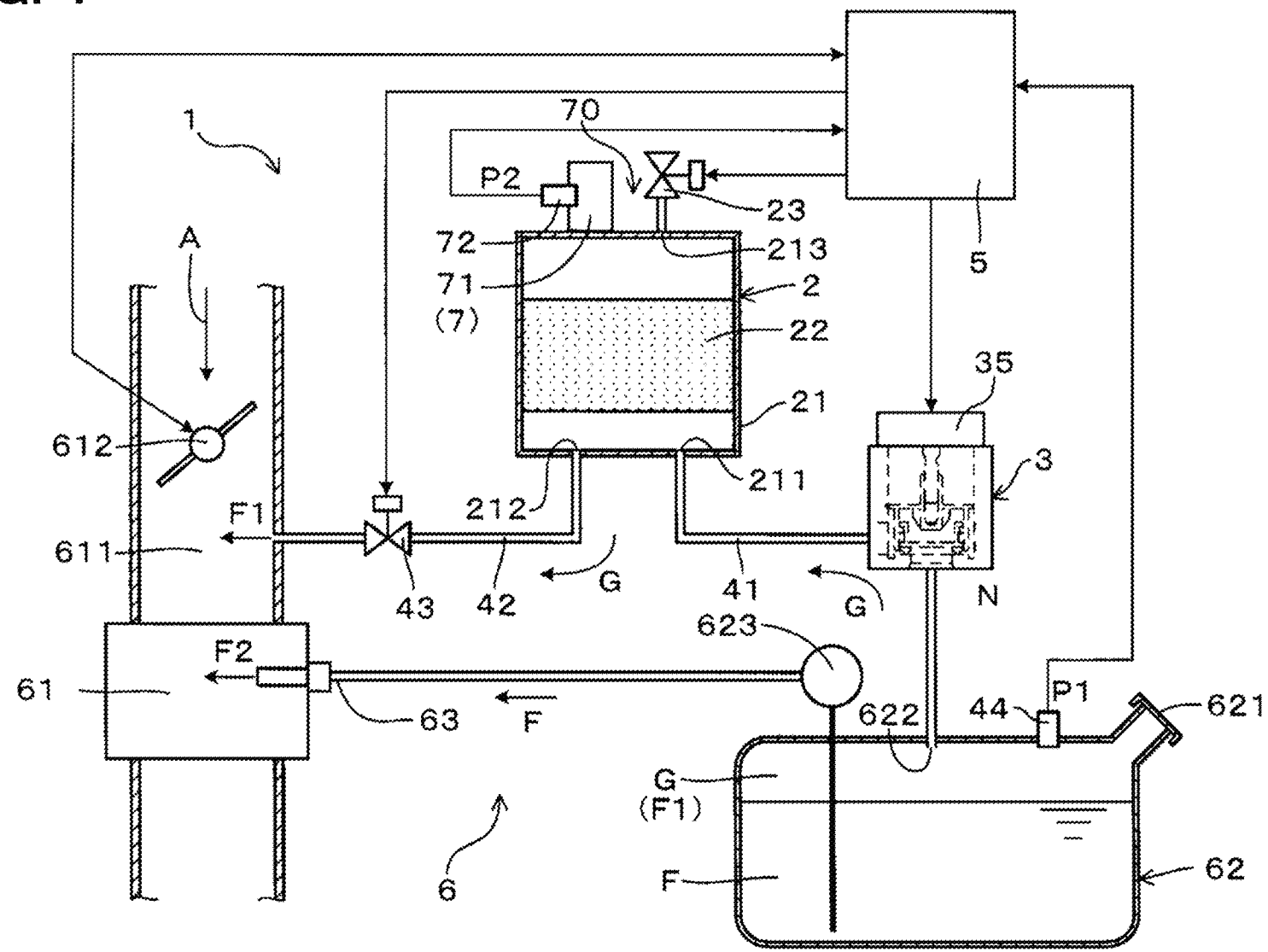
FIG. 1 is an explanatory diagram illustrating a part of a vehicle in which an evaporative fuel processing device according to a first embodiment is disposed.

Hereinafter, an example of the present disclosure will be described.

According to an example of the present disclosure, in a vehicle having an internal combustion engine, liquid fuel is stored in a fuel tank and is to be used for the internal combustion engine. The gas in the fuel tank exerts pressure such as vapor pressure of the evaporated fuel according to the temperature. When refueling the fuel tank, in order not to release the evaporated fuel to the outside, an evaporative fuel processing device having a canister configured to adsorb the evaporated fuel is used.

Then, before starting fuel supply to the fuel tank, a sealing valve provided in a vapor pipe connecting the fuel tank to the canister is opened to adsorb the fuel vapor in the fuel tank into the adsorbent in the canister. The fuel components adsorbed by the adsorbent of the canister is supplied to the intake pipe of the internal combustion engine and is used for combustion of the internal combustion engine. Further, the evaporated fuel in the fuel tank may be supplied to the intake pipe of the internal combustion engine by bypassing the canister.

The sealing valve used in the evaporative fuel processing device is a normally sealing valve that closes the vapor pipe connecting the fuel tank to the canister. In response to a signal sent from a control device to an actuator of the sealing valve, the sealing valve opens the vapor pipe. The opening/closing operation of the vapor pipe by using the sealing valve can be performed in various manners, such as a simple open/close operation where the opening degree is not adjusted, an operation where the opening degree is adjustable to several levels (such as two levels), and an operation where the opening degree is quantitatively adjusted.

According an example of the present disclosure, an evaporative fuel processing device quantitatively adjusts an opening degree of a sealing valve by using a stepping motor. In this evaporative fuel processing device, when the fuel tank is depressurized, the flow rate of gas flowing through the purge pipe from the fuel tank to the canister can be adjusted by changing a stroke amount of a sealing valve as the sealing valve. Further, the sealing valve in this evaporative fuel processing device is configured to learn the valve opening start position based on the stroke amount of a valve movable portion with respect to a valve seat in the valve opening direction when the internal pressure of the fuel tank has decreased by a predetermined value or more.

According to an example of the present disclosure, in order to learn the valve opening start position of the sealing valve, it is necessary to monitor the pressure of the fuel tank, when the stroke amount is gradually changed from the fully closed position to open valve opening, to detect the pressure decrease due to the communication between the fuel tank and the canister.

However, in a case where the pressure in the fuel tank before the learning is close to the atmospheric pressure, the pressure decrease in the fuel tank is small even when the valve opening start position is reached, and therefore, the valve opening start position may not be detected or may be erroneously detected. Therefore, according to an example of the present disclosure, a prohibiting unit prohibits learning when the detected differential pressure between the internal pressure and the atmospheric pressure is small to suppress erroneous learning of the valve opening start position.

On the other hand, in a hybrid vehicle (HV vehicle) and a plug-in hybrid vehicle (PHV vehicle), which has been increasing in recent years, the engine has less opportunities to operate, and therefore, the amount of heat received by the fuel tank is also reduced. In an environment where the temperature of the fuel tank is low, the pressure of the vapor-phase gas less likely increases due to the volatilization of the fuel, and therefore, the pressure hardly reaches the pressure range in which the valve opening start position can be learned. As a result, the opportunities of the learning is reduced, and therefore, the accuracy of the opening control of the sealing valve based on the learning result is lowered.

An evaporative fuel processing device according to an example of the present disclosure is provided in a vehicle 6 that includes an internal combustion engine 61 and a fuel tank 62 and is configured to process evaporated fuel F1 which is fuel evaporated in the fuel tank.

The evaporative fuel processing device 1 includes: a canister 2 including an adsorbent 22 to adsorb evaporative fuel; a sealing valve 3 provided in a vapor pipe 41 connecting the fuel tank to the canister, the sealing valve being configured to be operated by an actuator 35 to quantitatively adjust an opening degree for opening and closing the vapor pipe; a tank pressure sensor 44 provided in the fuel tank and configured to detect a tank-side pressure P1 which is a pressure of vapor-phase phase gas G in the fuel tank; a purge valve 43 provided in a purge pipe 42 connecting the canister to an intake pipe 611 of the internal combustion engine, the purge valve configured to open and close the purge pipe; a control device 5 configured to selectively execute each of a sealing operation to cause the sealing valve to close the vapor pipe to seal the fuel tank, a vapor operation 501 to cause the sealing valve to open the vapor pipe to purge the vapor-phase gas in the fuel tank into the canister, a canister purge operation 502 to cause the purge valve to open the purge pipe to purge fuel components in the canister into the intake pipe, a purge operation 503 to cause the sealing valve to open the vapor pipe and at the same time to cause the purge valve to open the purge pipe to purge the vapor-phase gas in the fuel tank into the intake pipe by bypassing the canister, and a learning operation 504 to learn an opening degree of the sealing valve when the vapor pipe is opened; an open/close valve 23 configured to open and close a pressure release port 213 that is configured to open the canister to an atmosphere; and a pressure variable device 7 provided to the canister and configured to operate while the open/close valve is closed to variably adjust a canister-side pressure P2 that is a pressure in the vapor pipe on a side of the canister with respect to the sealing valve.

The control device includes: an opening degree command unit 51 configured to transmit an opening degree command amount K1, which is for determining the opening degree of the sealing valve, to the actuator, a valve opening start learning unit 52 configured to set a pressure difference ΔP between the tank-side pressure and the canister-side pressure before opening the vapor pipe to a specified value P0 or more in the learning operation and learn the valve opening start amount K0 based on the opening degree command amount when the tank-side pressure changes when the opening degree command amount is gradually increased from zero, and a pressure difference forming unit 53 configured to cause the pressure variable device to change the canister-side pressure and control opening and closing of the open/close valve and the sealing valve to form a state in which the pressure difference becomes equal to or higher than the specified value in a state in which the sealing valve is closed.

The control device is configured to determine the opening degree command amount of the opening degree command unit based on the valve opening start amount, which has been learned, when causing the sealing valve to open to perform the vapor operation or the purge operation.

According to the example of the control device for the evaporated fuel processing device, the valve opening start learning unit learns the valve opening start amount in the state in which the pressure difference between the canister-side pressure and the tank-side pressure is the specified value or more. The control device includes the pressure difference forming unit. Therefore, in a state in which the predetermined pressure difference does not arises, the control device causes the pressure variable device to change the canister-side pressure and further to appropriately control the opening and closing of the open/close valve and the sealing valve, thereby to enable to form the predetermined pressure difference with respect to the tank-side pressure while the sealing valve is closed.

In this way, the configuration enables to learn the valve opening start amount in the state where the pressure difference that is the specified value or more arises in advance or is formed without influence of the environment inside and outside the fuel tank. Further, the configuration enables to change the tank-side pressure quickly when the opening degree command amount is gradually increased from zero, thereby to enable to accurately learn the valve opening start amount and to enable to increase the opportunities of the learning.

According to the evaporated fuel treatment device of this example, the configuration enables to accurately learn the valve opening start position and to increase the opportunities of the learning, even in an environment where the pressure in the fuel tank less likely changes with respect to the atmospheric pressure. Therefore, it is possible to provide the evaporative fuel processing device that is configured to control the opening degree of the sealing valve more appropriately and quantitatively.

As described above, the evaporative fuel processing device according to the example of the present disclosure enables to accurately learn the valve opening start position, even in an environment where the pressure in the fuel tank less likely changes with respect to the atmospheric pressure, thereby to enable to increase the opportunities of the learning and to enable to control the opening degree of the sealing valve more appropriately and quantitatively.

A preferred embodiment of the above-described evaporative fuel processing device will be described with reference to the drawings.

First Embodiment

As shown in FIG. 1, an evaporative fuel processing device 1 according to the present embodiment is provided in a vehicle 6. The vehicle 6 includes an internal combustion engine 61 and a fuel tank 62. The evaporative fuel processing device 1 is configured to process evaporated fuel F1 that is fuel F evaporated in the fuel tank 62. The evaporative fuel processing device 1 includes a canister 2, a vapor pipe 41, a sealing valve 3, a tank pressure sensor 44, a purge pipe 42, a purge valve 43, an open/close valve 23, a control device 5, and a pressure variable device 7.

The canister 2 includes an adsorbent 22 that adsorbs the evaporated fuel F1. The vapor pipe 41 connects the fuel tank 62 to the canister 2. The sealing valve 3 is provided in the vapor pipe 41 and includes a stepping motor 35 that acts as an actuator. The stepping motor 35 is configured to quantitatively adjust the opening degree of the vapor pipe 41 in accordance with operation of the stepping motor 35. The tank pressure sensor 44 is provided in the fuel tank 62 and detects a tank-side pressure P1, which is pressure of vapor-phase gas in the fuel tank 62. The purge pipe 42 connects the canister 2 to an intake pipe 611 of the internal combustion engine 61. The purge valve 43 is provided in the vapor pipe 42 and is configured to open and close the vapor pipe 42.

The open/close valve 23 opens and closes a pressure release port 213 that is configured to open the canister 2 to the atmosphere. The pressure variable device 7 is provided in the canister 2 and operates in a state where the open/close valve 23 is closed. In this way, the pressure variable device 7 is configured to variably adjust a canister-side pressure P2, which is pressure on the side of the canister 2 with respect to the sealing valve 3 in the vapor pipe 41.

Figure 2:
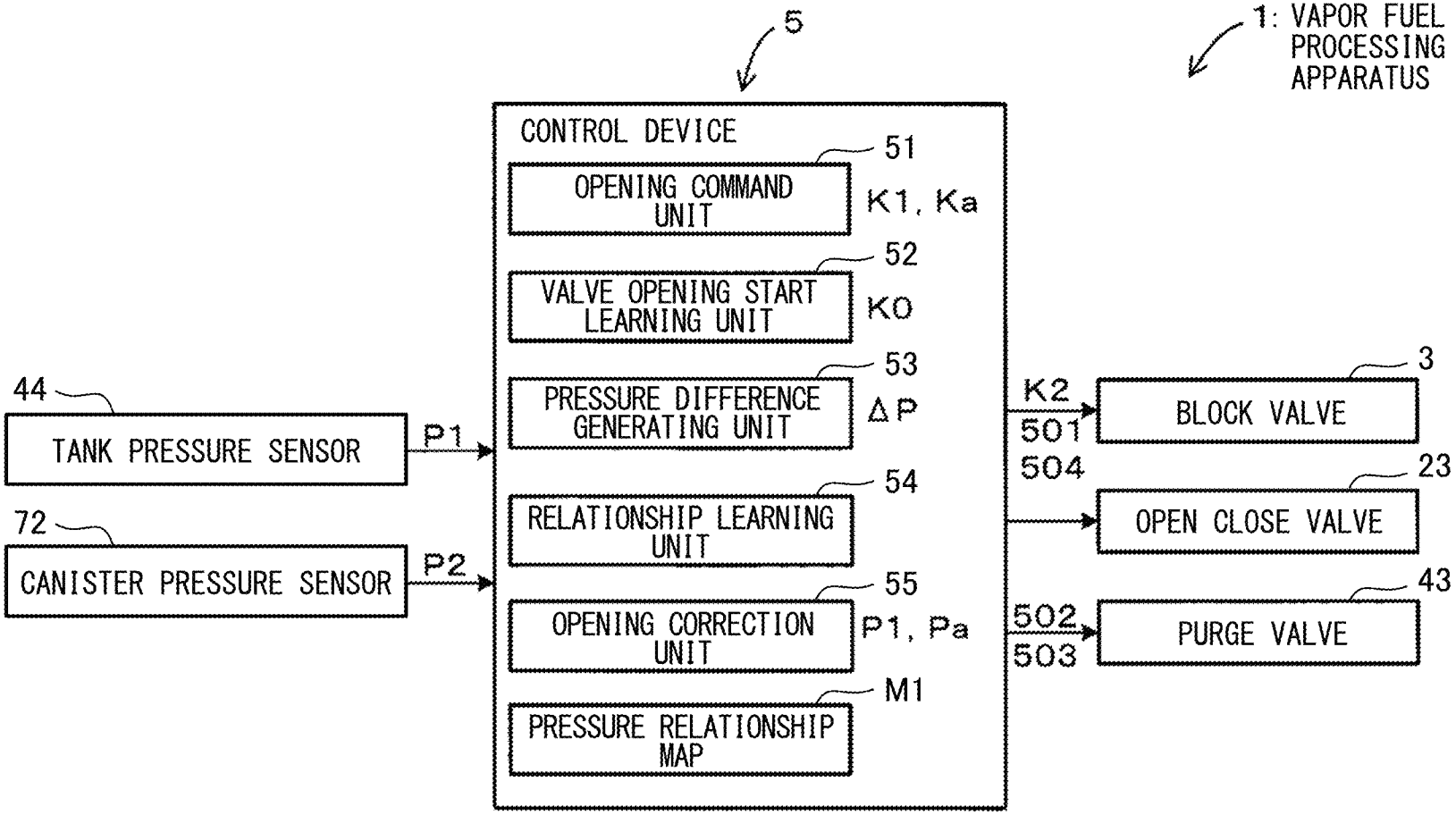
FIG. 2 is an explanatory diagram schematically showing a control device of the evaporative fuel processing device according to the first embodiment.

As shown in FIG. 2, the control device 5 is configured to execute each of a closing operation, a vapor operation 501, a canister purge operation 502, a purge operation 503, and a learning operation 504.

The sealing operation is an operation in which the vapor pipe 41 is closed by using the sealing valve 3 to seal the fuel tank 62.

The vapor operation 501 is an operation to open the vapor pipe 41 by using the sealing valve 3 and to purge the gas G in the fuel tank 62 to the canister 2.

The canister purge operation 502 is an operation to open the purge pipe 42 by using the purge valve 43 and to purge the fuel component in the canister 2 into the intake pipe 611.

The purge operation 503 is an operation to open the vapor pipe 41 by using the sealing valve 3 and to open the purge pipe 42 by using the purge valve 43 to purge the gas G in the fuel tank 62 to the intake pipe 611 by bypassing the canister 2.

The learning operation 504 is an operation to learn the opening degree of the sealing valve 3 when the vapor pipe 41 is opened.

Further, the control device 5 includes an opening degree command unit 51, a valve opening start learning unit 52, and a pressure difference forming unit 53. Further, the control device 5 performs the learning operation 504 is in a state where the pressure difference ΔP having a specified value P0 or more is formed by using the pressure difference forming unit 53. Further, the control device 5 causes the valve opening start learning unit 52 to learn the valve opening start amount K0. When the sealing valve 3 is opened to perform the vapor operation 501 or the purge operation 503, the control device 5 determines the opening degree command amount K1 of the opening degree command unit 51 based on the valve opening start amount K0 of the valve opening start learning unit 52.

The opening degree command unit 51 is a control unit that transmits an opening degree command amount K1 to the stepping motor 35. The opening degree command amount K1 determines the opening degree of the sealing valve 3.

The valve opening start learning unit 52 is a control unit that sets the pressure difference ΔP, which is between the tank-side pressure P1 and the canister-side pressure P2 before opening the vapor pipe 41, to a specified value P0 or more in the learning operation 504. The valve opening start learning unit 52, when the opening degree command amount K1 is gradually increased from zero, learns the valve opening start amount K0 based on the opening degree command amount K1 when the tank-side pressure P1 starts to decrease.

The pressure difference forming unit 53 is a control unit to cause the pressure variable device 7 to change the canister-side pressure P1 and to control the opening and closing of the open/close valve 23 and the sealing valve 3 to form a state in which the pressure difference ΔP between the tank-side pressure P1 and the canister-side pressure P2, when the sealing valve 3 is closed, becomes a specified value P0 or more.

Preferably, in the learning operation 504, when the pressure difference ΔP is less than the specified value P0 or when the pressure difference ΔP is estimated to be less than the specified value P0, the control device 5 causes the pressure difference forming unit 53 to form a state where the pressure difference ΔP becomes the specified value P0 or more.

Further preferably, the control device 5 may include a relationship learning unit 54, an opening degree correction unit 55, and a pressure relationship map M1 which is a relationship map.

The evaporative fuel processing device 1 may include a leak check module 70 which is a leak diagnostic device. In this configuration, the pressure variable device 7 may form a part of the leak check module 70.

Hereinafter, the evaporative fuel processing device 1 of the present embodiment will be described in detail.

(EVAPORATIVE FUEL PROCESSING DEVICE 1)

As shown in FIG. 1, in the vehicle 6, the evaporative fuel processing device 1 is used such that the evaporated fuel F1, which is part of the gas G in the fuel tank 62, is not released into atmosphere when fuel F is supplied to the fuel tank 62. The evaporated fuel F1 in the fuel tank 62 is stored in the canister 2 and then discharged to the intake pipe 611 of the internal combustion engine 61 or is discharged to the intake pipe 611 of the internal combustion engine 61 by bypassing the canister 2. Then, the fuel component of the evaporated fuel F1 is used for combustion in the internal combustion engine 61.

The flow rate of combustion air A supplied from the intake pipe 611 to the internal combustion engine 61 is adjusted by operating a throttle valve 612 provided in the intake pipe 611. The internal combustion engine 61 is provided with a fuel injection device 63 that injects fuel F supplied from the fuel tank 62.

(FUEL TANK 62)

As shown in FIG. 1, the fuel tank 62 stores the fuel F used for the combustion of the internal combustion engine 61. The fuel tank 62 includes a fuel supply port 621, a purge port 622, and a fuel pump 623. The fuel supply port 621 is used to receive fuel F supplied to the fuel tank 62 from outside. The purge port 622 is connected to the vapor pipe 41. The fuel pump 623 is used when supplying the fuel F to the fuel injection device 63 of the internal combustion engine 61.

A cap that closes the fuel supply port 621 during a normal state is provided over the fuel supply port 621. The cap is opened when refueling through the fuel supply port 621. In the fuel tank 62, a sensor is provided for sensing the tank-side pressure P1 and for stopping refueling by using the refueling nozzle. The fuel pump 623 supplies liquid phase fuel from the fuel tank 62 to the fuel injection device 63.

(CANISTER 2)

As shown in FIG. 1, the canister 2 includes a case 21 and an adsorbent 22 such as activated carbon. The adsorbent is in the case 21 and adsorbs the evaporated fuel (i.e., fuel vapor) F1. The case 21 of the canister 2 includes an inlet 211, an outlet 212, and a pressure release port 213. The inlet 211 is connected to the vapor pipe 41 and allows gas G to enter. The outlet 212 is connected to the purge pipe 42 and allows fuel components to exit. The pressure release port 213 is openable to the atmosphere. The inlet 211 and the outlet 212 open in a space formed between the adsorbent 22 and the case 21 on one end surface side of the adsorbent 22. The pressure release port 213 opens in a space formed between the adsorbent 22 and the case 21 on the other end surface side.

The open/close valve 23 is provided to the pressure release port 213 thereby to enable to communicate the inside of the canister 2 with the atmosphere and to block the communication of the canister 2 with the atmosphere. When the gas G is purged (exhausted) from the fuel tank 62 to the canister 2, the open/close valve 23 opens the pressure release port 213 to the atmosphere. Then, in the canister 2, the fuel components in the evaporated fuel F1 of the gas G are adsorbed by the adsorbent 22, while the pressure in the canister 2 becomes equal to atmospheric pressure.

The fuel components adsorbed by the adsorbent 22 of the canister 2 pass through the purge pipe 42 and are discharged to the intake pipe 611 of the internal combustion engine 61. At this time, the pressure release port 213 of the canister 2 is opened to the atmosphere, and the purge pipe 42 is opened by the purge valve 43. The fuel components adsorbed by the adsorbent 22 are discharged to the intake pipe 611 of the internal combustion engine 61 by an airflow caused due to the pressure difference between the pressure of the atmosphere entering the canister 2 through the pressure release port 213 and the negative pressure in the intake pipe 611.

(SEALING VALVE 3)

Figure 3:
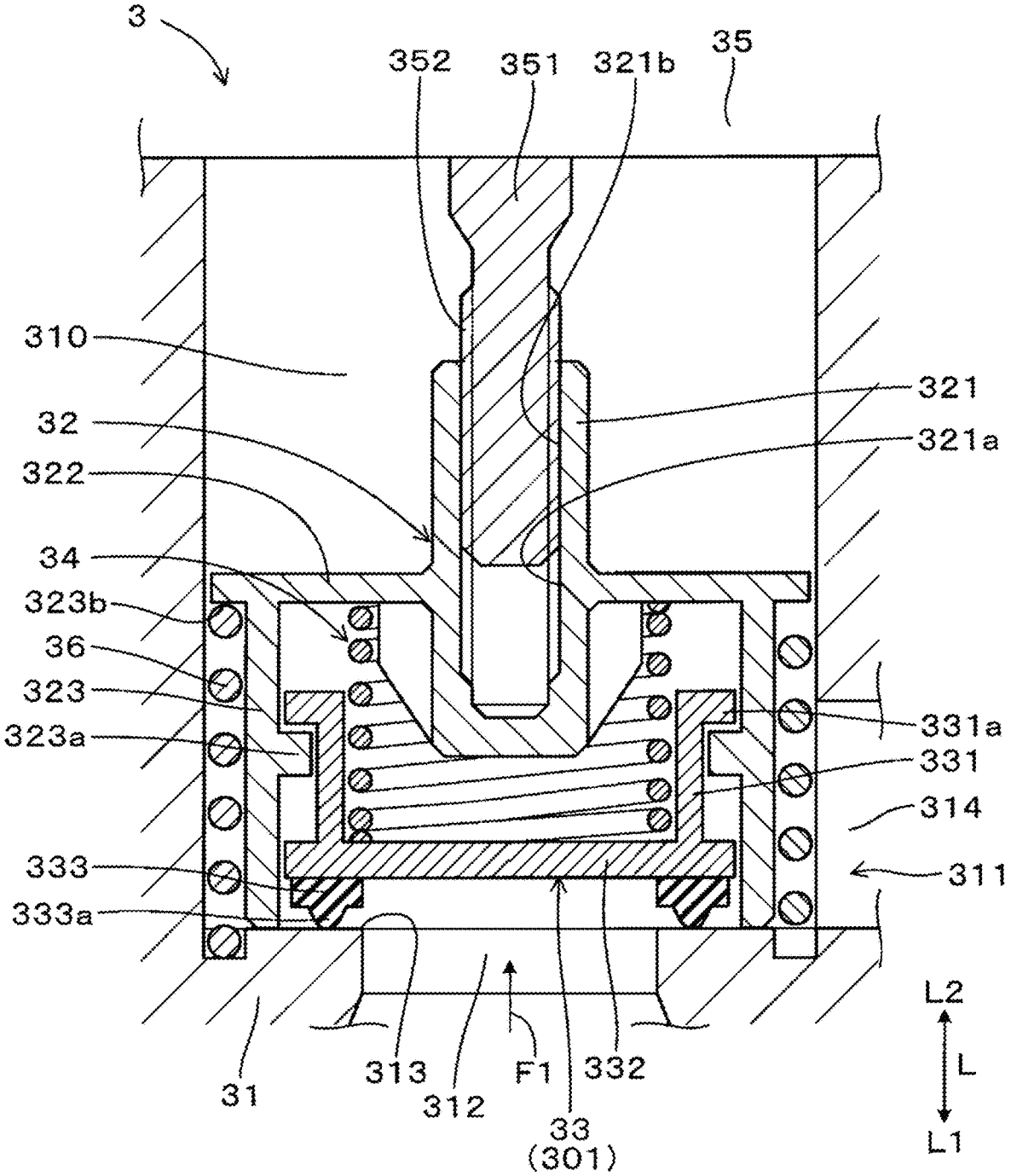
FIG. 3 is an explanatory diagram illustrating a sealing valve in a closed position in the evaporative fuel processing device according to the first embodiment.
Figure 4:
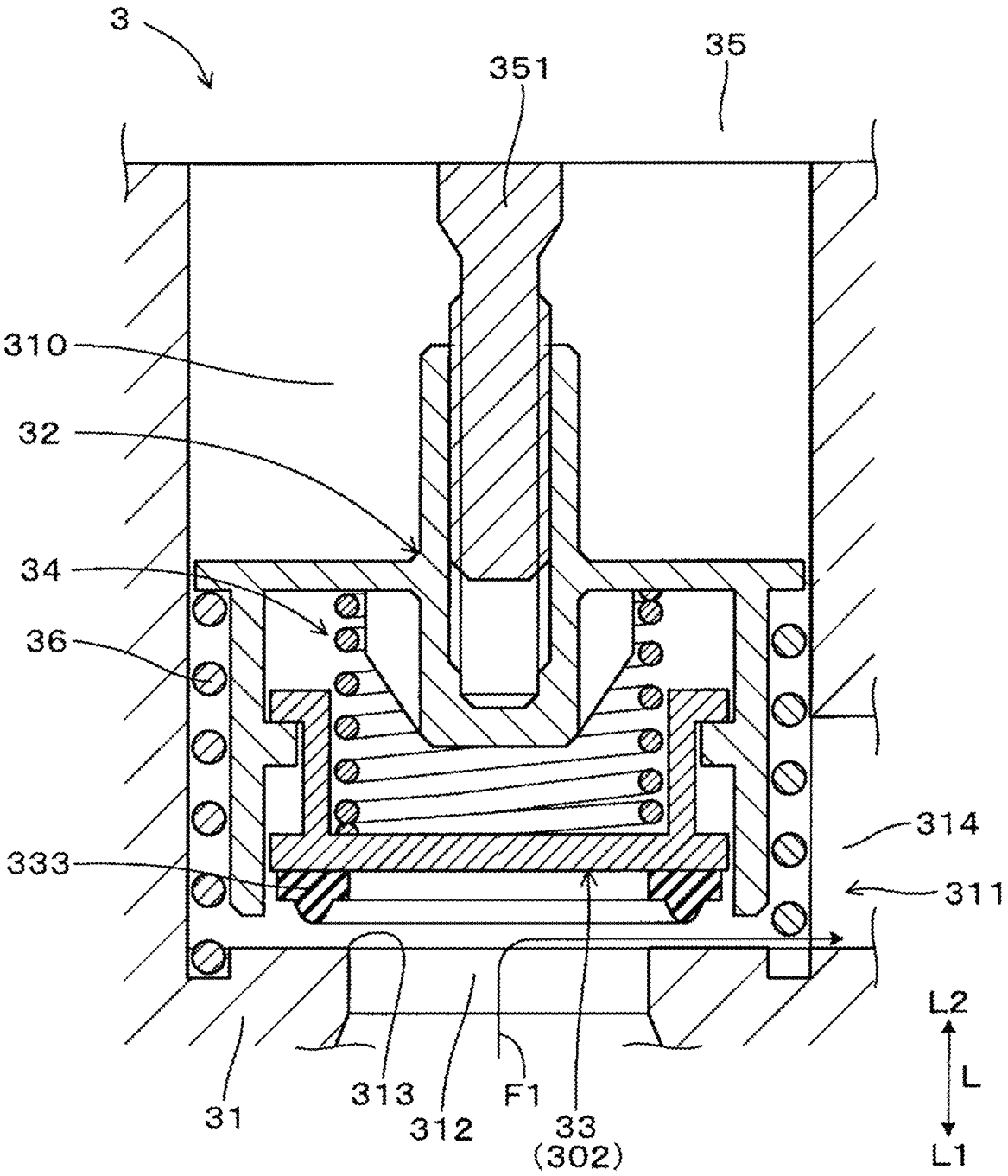
FIG. 4 is an explanatory diagram showing a sealing valve in an open position in the evaporative fuel processing device according to the first embodiment.

As shown in FIGS. 3 and 4, the sealing valve 3 of the present embodiment includes a housing 31, a valve guide 32, a valve 33, a valve-side spring 34, a stepping motor 35, and a guide-side spring 36. The housing 31 forms a case for the sealing valve 3, and includes a sealing passage 311 connected to the vapor pipe 41. The valve guide 32 is configured to be movable forward and backward with respect to the housing 31 by converting the rotational force of the stepping motor 35 into an actuating force. The valve 33 is slidably engaged with the valve guide 32 and is configured to open and close a sealing passage 311 of the housing 31.

The valve-side spring 34 is sandwiched between the valve guide 32 and the valve 33 and biases the valve 33 in a direction to close the sealing passage 311. The guide-side spring 36 is disposed on the outer periphery of the valve guide 32, and serves to reduce rattling (backlash) generated between an output shaft 351 of the stepping motor 35 and the valve guide 32.

(HOUSING 31)

As shown in FIGS. 3 and 4, the housing 31 includes an accommodation hole 310 for housing the valve guide 32 and the sealing passage 311 which is in communication with the accommodation hole 310. The accommodation hole 310 is formed in a proximal side L2 along the axial direction L of the housing 31. The sealing passage 311 includes an inflow portion 312 and an outflow portion 314. The inflow portion 312 is connected to the fuel tank 62. The gas G flows in through the inflow portion 312. Further, the gas G flows out through the outflow portion 314 to the canister 2. The inflow portion 312 is formed parallel to the accommodation hole 310 at the distal side L1 of the accommodation hole 310, and the outflow portion 314 is formed perpendicular to the accommodation hole 310.

(AXIAL DIRECTION L)

The axial direction L is a direction parallel to the direction along which the valve 33 opens and closes the sealing passage 311. In the axial direction L of the sealing valve 3, the side on which the stepping motor 35 is disposed is referred to as the proximal side L2, and the side on which the sealing passage 311 is closed by the valve 33 is referred to as the distal side L1.

(VALVE GUIDE 32)

As shown in FIGS. 3 and 4, the valve guide 32 includes a center shaft portion 321, a guide disc portion 322, a guide tubular portion 323, and a locking portion 323*a*. The center shaft portion 321 is fixed to the output shaft 351 of the stepping motor 35. The guide disk portion 322 is formed around the center shaft portion 321. The guide tubular portion 323 is formed in a cylindrical shape protruding from the peripheral portions of the guide disk portion 322. The locking portion 323*a* is formed on the inner peripheral surface of the guide tubular portion 323 to lock the valve 33. A male threading 352 is formed on the outer surface of the output shaft 351 of the stepping motor 35. A hollow hole 321*a* is formed at the center of the center shaft portion 321 of the valve guide 32, and a female threading 321*b* is formed on the inner surface of the hollow hole 321*a*. The female threading 321*b* is screwed together with the male threading 352 of the output shaft 351 of the stepping motor 35. The locking portion 323*a* is formed as a protruding portion that protrudes inward from the inner peripheral surface of the guide tubular portion 323. The main body of the stepping motor 35 is fixed to the housing 31.

(VALVE 33)

As shown in FIGS. 3 and 4, the valve 33 includes a valve tubular portion 331, a valve closing plate portion 332, and a sealing member 333. The valve tubular portion 331 is disposed inside the guide tubular portion 323 of the valve guide 32. Further, the valve tubular portion 331 includes a locking protrusion 331*a* configured to lock with the locking portion 323*a* of the valve guide 32. The valve closing plate portion 332 closes the end portion of the valve tubular portion 331. The sealing member 333 is a ring-shaped member disposed on the valve closing plate portion 332. The sealing member 33 is configured to close an opening portion 313 of the sealing passage 311. The valve tubular portion 331 is formed in a cylindrical shape and guides the outer periphery of the valve-side spring 34. The locking protrusion 331*a* is formed so as to protrude radially outward from an end portion of the valve tubular portion 331 on the proximal side L2 of the axial direction L. The valve closing plate portion 332 and the locking protrusion 331*a* are guided in the axial direction L by the inner circumference of the guide tubular portion 323 of the valve guide 32.

The sealing member 333 is arranged in the housing 31 at the periphery of the opening portion 313 of the inflow portion 312 of the sealing passage 311. A sealing portion 333*a* is formed in the housing 31 on the distal side L1 of the sealing member 333 in the axial direction. The sealing portion 333*a* is configured to elastically deform when coming into contact with the peripheral portion of the opening portion 313 of the inflow portion 312 of the sealing passage 311. The position of the distal side L1 of the entirety of the sealing portion 333*a* in the axial direction L is within an imaginary plane parallel to the surface of the valve closing plate portion 332 on the proximal side L2 in the axial direction L.

The valve 33 is biased toward the distal side L1 in the axial direction L by the valve-side spring 34, and the locking protrusion 331*a* of the valve tubular portion 331 of the valve 33 engages with the locking portion 323*a* of the guide tubular portion 323 of the valve guide 32. Due to this, the valve 33 is retained within the valve guide 32. As shown in FIGS. 3 and 4, the valve 33 is movable between a closed position 301 and an open position 302. Specifically, the valve 33 is normally in the closed position 301 due to being biased by the valve-side spring 34 to close the sealing passage 311. Further, the valve 33 is configured to be moved toward the open position 302 in accordance with a movement amount of the valve guide 32 toward the proximal side L2 in the axial direction L. The open position 302 determines the opening degree of the sealing passage 311. The closed position 301 is also referred to as an initial position (normal position) of the valve 33. In other words, the default state of the valve 33 is to close the sealing passage 311 with the sealing member 333.

As shown in FIG. 3, the opening portion 313 of the inflow portion 312 of the sealing passage 311 is normally closed by the sealing portion 333*a* of the sealing member 333 of the valve 33. In this state, the valve-side spring 34 is in a compressed state and applies a spring force on the valve closing plate portion 332 toward the distal side L1 of the axial direction L. At the same time, the gas G in the inflow portion 312 exerts a fuel pressure on the valve closing plate portion 332 toward the proximal side L2 of the axial direction L. In the state shown in FIG. 3, the spring force is greater than the fuel pressure. As a result, the valve 33 is maintained at the closed position 301, and the sealing passage 311 is maintained in a closed state.

On the other hand, as shown in FIG. 4, when the valve guide 32 is moved by the stepping motor 35 toward the proximal side L2 in the axial direction L in order to open the opening portion 313 of the inflow portion 312 of the sealing passage 311, the valve 33 and the valve-side spring 34 are also moved toward the proximal side L2 in the axial direction L. As a result, the sealing portion 333*a* of the sealing member 333 of the valve 33 separates from the peripheral edge of the opening portion 313 of the inflow portion 312 of the sealing passage 311 in the housing 31, and the valve 33 moves to the open position 302, and the sealing passage 311 is opened. In this manner, the amount by which the valve guide 32, the valve 33, and the valve-side spring 34 move toward the proximal side L2 in the axial direction L is determined according to the number of drive pulses applied to the stepping motor 35. Thus, the opening amount of the sealing passage 311 is quantitatively determined.

(VALVE-SIDE SPRING 34, GUIDE-SIDE SPRING 36)

As shown in FIGS. 3 and 4, the valve-side spring 34 and the guide-side spring 36 are compression coil springs (torsion coil springs) in which a round wire as a strand is spirally twisted. The valve-side spring 34 applies a predetermined biasing force to the valve 33 to close the sealing passage 311, and is configured to retain the valve 33 at the closed position 301 through this biasing force. The guide-side spring 36 is arranged on the outer circumference of the guide tubular portion 323 of the valve guide 32. The guide-side spring 36 is interposed between a step portion 323*b*, which is formed on the guide tubular portion 323, and the peripheral edge of the opening portion 313 of the inflow portion 312 of the sealing passage 311 in the housing 31.

The valve guide 32 is biased by the guide-side spring 36 to the proximal side L2 in the axial direction L, and therefore, a gap between the male threading 352 of the output shaft 351 of the stepping motor 35 and the female threading 321*b* of the central hole of the center shaft portion 321 of the valve guide 32 is held on one side in the axial direction L. Thus, when the output shaft 351 of the stepping motor 35 rotates, backlash between the output shaft 351 and the valve guide 32 in the axial direction L is reduced.

(PURGE VALVE 43)

As shown in FIG. 1, the purge valve 43 is configured to open the purge pipe 42 when purging (discharging) the fuel component adsorbed by the adsorbent 22 of the canister 2 to the intake pipe 611 of the internal combustion engine 61 and when purging (discharging) the gas G in the fuel tank 62 to the intake pipe 611 of the internal combustion engine 61. The purge valve 43 of this embodiment has a function of opening and closing the purge pipe 42 in an on or off manner.

The purge valve 43 may be repeatedly opened and closed using a pulse-shaped energization command signal, and by controlling the on/off ratio (duty ratio) of the pulse width, the opening degree of the purge pipe 42 may be quantitatively adjusted. In this case, in the canister purge operation, the flow rate of the purge gas containing fuel components flowing through the purge valve 43 can be appropriately adjusted. Alternatively, the purge valve 43 may be a control valve that can quantitatively adjust the opening degree at which the purge pipe 42 is opened.

(TANK PRESSURE SENSOR 44)

As shown in FIG. 1, the tank pressure sensor 44 is a pressure gauge that detects the tank-side pressure in the fuel tank 62. Most of the tank-side pressure in the fuel tank 62 is due to the vapor pressure of the evaporated fuel F1.

(CONTROL DEVICE 5)

As shown in FIGS. 1 and 2, the control device 5 of the evaporated fuel processing device 1 is disposed in a control device of the vehicle. The sealing valve 3, the purge valve 43, and the open/close valve 23 are connected to the control device 5 of the vehicle 6 as output devices, and are configured to open and close in response to a command from the control device 5. When a predetermined number of drive pulses are supplied from the control device 5 to the stepping motor 35 in the sealing valve 3, the valve 33 opens the opening portion 313 of the sealing passage 311. The tank pressure sensor 44, is connected to the control device 5 of the vehicle 6 as input devices, and are configured to transmit information on the tank-side pressure P1 to the control device 5.

Note that the control device 5 of the evaporated fuel processing device 1 may be provided separately from the control device of the vehicle 6, and may be connected to a separate control device disposed within the control device of the vehicle 6 so that data can be transmitted and received between the evaporated fuel processing device 1 and the vehicle 6.

In a normal state, in the internal combustion engine (engine) 61 of the vehicle 6, the amount (mass) of the combustion air A supplied to the intake pipe 611 is adjusted by the opening degree of the throttle valve 612, and the supply amount (mass) of the fuel F to the internal combustion engine 61 is adjusted by the injection amount of the fuel injection device 63. Then, the control device 5 controls an air-fuel ratio (A/F) as the supply amount of combustion air to the fuel supply amount to be a target air-fuel ratio.

When the evaporated fuel F1 is not purged from the fuel tank 62 or the canister 2 to the intake pipe 611, the fuel supply to the internal combustion engine 61 is only the supply of the injected fuel F2 by using the fuel injection device 63, and a normal feedback control is performed on the internal combustion engine 61. When the evaporated fuel F1 is purged from the canister 2 or the fuel tank 62 to the intake pipe 611 of the internal combustion engine 61 by performing the purge operation 503 or the canister purge operation 502, the control device 5 reduces the amount of fuel supplied from the fuel injection device 63 to the internal combustion engine 61 so as to regulate the air-fuel ratio in the internal combustion engine 61.

(Operation 501, 502, 503, 504 by the Control Device 5)

The sealing operation by the control device 5 refers to an operation in which the valve 33 of the sealing valve 3 closes the opening portion 313 of the sealing passage 311 and maintains the fuel tank 62 in a sealed state. During the sealing operation, the rotation position of the output shaft 351 of the stepping motor 35 is held to maintain a state in which the valve 33 is at the closed position (initial position) 301. During normal operation of the evaporative fuel processing device 1, the control device 5 executes the sealing operation. In other words, the sealing operation is performed by default.

The vapor operation 501 by the control device 5 is performed when, prior to refueling the fuel tank 62, the vapor phase fuel G in the fuel tank 62 is purged to the canister 2. The tank-side pressure P1 is decreased by performing the vapor operation 501. When the fuel supply port 621 of the fuel tank 62 is opened, the evaporated fuel F1 in the vapor-phase gas G of the fuel tank 62 is restricted from being released into the atmosphere.

The canister purge operation 502 by the control device 5 is performed when the fuel component adsorbed by the adsorbent 22 of the canister 2 is to be used in the internal combustion engine 61 to burn a mixture of fuel and combustion air.

The purge operation 503 by the control device 5 is performed when, after the fuel tank 62 is refueled and the internal combustion engine 61 initiates a combustion operation, the gas G in the fuel tank 62 is supplied to the intake pipe 611 of the internal combustion engine 61. In the purge operation 503, the evaporated fuel F1 in the gas G passes through a part of the canister 2 without being adsorbed by the adsorbent 22 of the canister 2. By performing the purge operation 503, the tank-side pressure P1 can be reduced during the combustion operation of the internal combustion engine 61.

The learning operation 504 by the control device 5 is performed while the sealing operation by the control device 5 is being performed, and includes gradually increasing the opening degree command amount K1, which is sent from the opening degree command unit 51 to the stepping motor 35, from zero. Further, the learning operation 504 is performed during a process in which the tank-side pressure P1 changes while the sealing operation is being performed.

In the closed state of the fuel tank 62, that is, in the state in which the valve 33 of the sealing valve 3 closes the opening portion 313 of the sealing passage 311, the learning operation 504 is performed to increase the command amount to the stepping motor 35, thereby to cause the valve 33 to be lifted from the opening portion 313 at a certain time point and to open the sealing passage 311. The relationship with the valve opening start amount K0 is learned based on the change in the tank-side pressure P1 and the opening degree command amount K1 at this time. Further, by performing the learning operation 504, a pressure relationship map M1 between the valve opening start amount K0 and the tank-side pressure P1 can be obtained for multiple cases where the tank-side pressure P1 before the start of the learning operation 504 is different.

(Pressure Variable Device 7 and Leak Check Module 70)

As shown in FIG. 1, the evaporative fuel processing device 1 is configured to cause the leak check module 70 to detect a leak of the evaporated fuel F1 in the evaporated fuel flow path that is from the fuel tank 62 to the intake pipe 611 through the vapor pipe 41, the canister 2, and the purge pipe 42. The leak check module 70 includes a pressure variable device 7, which is provided to an opening in the case 21 of the canister 2, and the open/close valve 23.

The pressure variable device 7 has a pump function to variably adjust the pressure in the canister 2 to the depressurizing side or the pressurizing side. The pressure variable device 7 further includes a canister-side pressure sensor 72 for detecting the canister-side pressure P2. The canister-side pressure sensor 72, is connected to the control device 5 of the vehicle 6 and is configured to transmit information on the canister-side pressure P2 to the control device 5.

Figure 5:
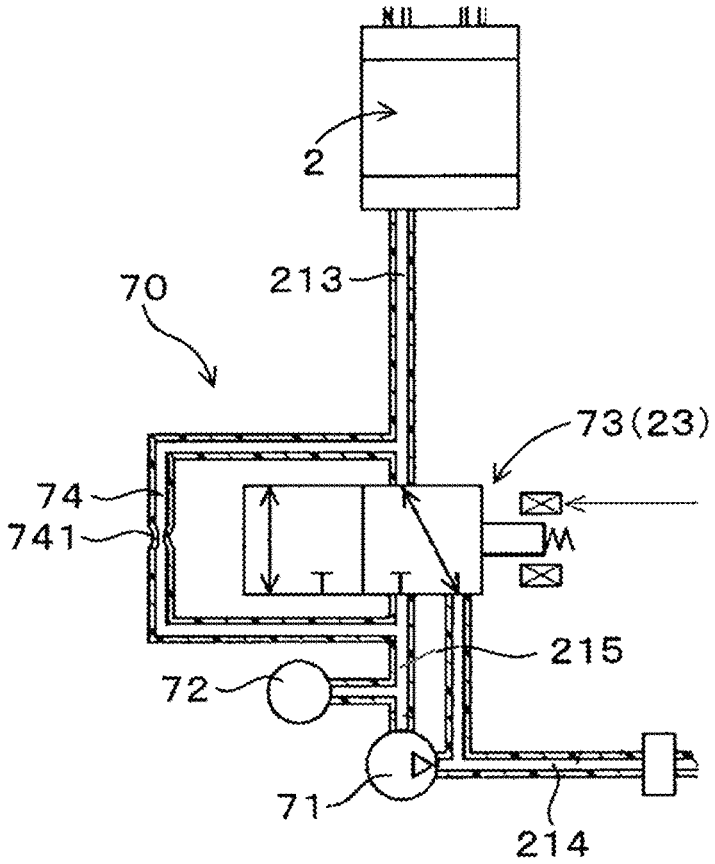
FIG. 5 is a diagram showing a configuration of a leak check module of an evaporative fuel processing device according to the first embodiment.

As shown in FIG. 5, the leak check module 70 includes a pump 71, a canister-side pressure sensor 72, and an orifice passage 74. The pump 71 is driven by a motor (not shown). The canister-side pressure sensor 72 detects the pressure in the canister 2 as the canister-side pressure P2 on the canister 2 side of the sealing valve 3. The orifice passage 74 includes a switching valve 73 that functions as the open/clos valve 23 and an orifice 741.

The pump 71 is a pump that changes the pressure in the canister 2 to the negative pressure side or the positive pressure side when the switching valve 73 is in the closed state. A negative pressure indicates a pressure lower than atmospheric pressure, and a positive pressure indicates a pressure higher than atmospheric pressure. When the pressure in the canister 2 is to be set to a negative pressure, a pressure reducing type leak check module 70 is used, and when the pressure in the canister 2 is to be set to a positive pressure, a pressure increasing type leak check module 70 is used.

Instead of using the canister-side pressure sensor 72, the leak check module 70 may detect a change in the pressure in the canister 2 based on a motor current when operating a pump 71 for reducing the pressure in the canister 2 to a negative pressure or increasing the pressure in the canister 2 to a positive pressure. In this case, the canister-side pressure P2 is detected by a pressure estimating unit provided in the control device 5 for estimating the pressure based on the motor current.

In this embodiment, the leak check module 70 of a decompression type including a negative pressure pump will be described below.

The switching valve 73 is configured as an electromagnetic two-position switching valve and is configured to switch between a first position, in which the pressure release port 213 of the canister 2 is directly connected to the atmospheric passage 214, and a second position, in which the pressure release port 213 of the canister 2 is connected to the atmospheric passage 214 through the pressure detection path 215 and the pump 71. When the switching valve 73 is in the first position, the inside of the canister 2 is open to the atmosphere. When the switching valve 73 is in the second position, the inside of the canister 2 is closed to the atmosphere. The pump 71 draws vapor-phase gas G introduced into the pressure detection path 215 and discharges the vapor-phase gas G to the atmospheric passage 214.

A canister-side pressure sensor 72 is provided in the pressure detection path 215. The canister-side pressure P2 detected by using the canister-side pressure sensor 72 changes according to the switching position of the switching valve 73 and the operating state of the pump 71. In the open state of the switching valve 73, the reference pressure Pref can be detected by using the orifice passage 74. In the closed state, the presence or absence of a leak can be detected from the change in the canister-side pressure P2 accompanying the operation of the pump 71. The orifice passage 74 connects the pressure release port 213 of the canister 2 with the pressure detection path 215 and is provided with an orifice 741 having a predetermined diameter serving as a throttle flow path in the middle of the orifice passage 74.

As shown in the drawing, when the pump 71 is driven while the switching valve 73 is in the open state at the first position, the vapor phase gas G in the pressure detection path 215 is drawn, and the atmosphere is introduced from the atmospheric passage 214 to the pressure release port 213 through the switching valve 73, and a flow is formed toward the pressure detection path 215 through the orifice passage 74. At this time, the flow from the pressure release port 213 to the pressure detection path 215 is restricted by the orifice passage 74, and therefore, the pressure in the pressure detection path 215 is reduced. The reference pressure Pref detected by using the canister-side pressure sensor 72 becomes a negative pressure according to the size of the orifice 741.

On the other hand, when the pump 71 is driven while the switching valve 73 is in the closed state at the second position, a negative pressure is introduced into the evaporated fuel flow path including the canister 2. At this time, the presence or absence of a leak in the evaporated fuel flow path can be detected by using the reference pressure Pref. That is, when the negative pressure generated in the evaporated fuel flow path is not large (the absolute value is small) as compared with the reference pressure Pref, it can be determined that a leak hole having a size that is equivalent to the orifice 741 or larger exists in the evaporated fuel flow path.

By using the leak check module 70 having this configuration, each part of the fuel vapor processing device 1 can be set in the negative pressure state, and the airtightness of the evaporative fuel path can be measured by monitoring the change in the pressure in the fuel vapor processing device 1.

Further, by using the pump 71 of the leak check module 70, the canister-side pressure P2 in the vapor pipe 41 that communicates with the canister 2 can be set in the negative pressure with respect to the tank-side pressure P1 of the fuel tank 62. Therefore, even in a state where the tank-side pressure P1 is substantially atmospheric pressure, the configuration enables to form the predetermined pressure difference ΔP with respect to the canister-side pressure P2 in order to learn the valve opening start position.

Even in the leak check module 70 that is of a pressure type in which the pump 71 is a positive pressure pump, a predetermined pressure difference ΔP can be formed by setting the canister-side pressure P2 to a positive pressure.

(SPECIFIC CONFIGURATION OF CONTROL DEVICE 5)

As shown in FIG. 2, the control device 5 includes an opening degree command unit 51, a valve opening start learning unit 52, a pressure difference forming unit 53, a relationship learning unit 54, and an opening degree correction unit 55. The control device 5 has a function to learn the valve opening start amount K0 as a dead zone caused in the sealing valve 3 and a function to correct the dead zone. By paying attention to the fact that the sealing valve 3 opens only when the command amount to the stepping motor 35 for driving the sealing valve 3 reaches a predetermined amount, the function to learn the dead zone is a function to learn the predetermined amount. The function to correct the dead zone is a function to correct the command amount by the predetermined amount as learned.

In the control device 5, the opening degree command unit 51 is configured to transmit an opening degree command amount K1 for determining the opening degree of the sealing valve 3 to the stepping motor 35. The valve opening start learning unit 52 has a function to learning the dead zone and performs a learning operation in a state where the tank-side pressure P1 and the canister-side pressure P2 have a pressure difference ΔP of a specified value P0 or more. Then, the valve opening start learning unit 52 is configured to lear the valve opening start amount K0 based on the opening degree command amount K1 when the tank-side pressure P1 changes.

In the present embodiment, the time when the tank-side pressure P1 changes can be the time when the sealing valve 3 changes from the closed state to the open state, that is, when the sealing valve 3 reaches the valve opening start position. Further, in a case where the tank-side pressure P1 is higher than the canister-side pressure P2 and where the sealing valve 3 is closed, it is regarded that the valve opening is started when the pressure decreases. In addition, in a case where the tank-side pressure P1 is lower than the canister-side pressure P2 and where the sealing valve 3 is closed, it is regarded that the valve opening is started when the pressure increases.

The pressure difference forming unit 53 changes the canister-side pressure P2 by utilizing the negative pressure or the positive pressure formed in the canister 2 by using the pump 71 of the leak check module 70. Then, the pressure difference forming unit 53 controls the opening and closing of the switching valve 73 and the sealing valve 3 serving as the open/close valve 23, thereby to form a state in which the canister-side pressure P2 and the tank-side pressure P1 have the pressure difference ΔP that is a specified value P0 or more. In this state, the valve opening start learning unit 52 learns the valve opening start amount K0, thereby to enable to detect the change in the tank-side pressure P1 easily.

Preferably, in the learning operation 504, when the pressure difference ΔP is less than the specified value P0 or when the pressure difference ΔP is estimated to be less than the specified value P0, the pressure difference forming unit 53 operates the pump 71 to form a state where the pressure difference ΔP becomes the specified value P0 or more. When the pressure difference ΔP is the specified value P0 or more or when the pressure difference ΔP is estimated to be the specified value P0 or more, the pump 71 need not be operated. The pressure difference forming unit 53 may compute the pressure difference ΔP before the learning operation 504 from the tank-side pressure P1 and the canister-side pressure P2 and may compare the pressure difference ΔP with a specified value P. Alternatively, the pressure difference forming unit 53 may estimate the pressure difference ΔP before the learning operation 504 based on the tank-side pressure P1. For example, unless the tank-side pressure P1 is higher than a pressure obtained by adding the specified value P0 to the atmospheric pressure, it can be estimated that the pressure difference ΔP is less than the specified value P0. In this way, the learning operation 504 can be performed with a sufficient pressure difference ΔP regularly.

Specifically, the pressure difference forming unit 53 is configured to, in a state where the sealing valve 3 is closed and where the tank-side pressure P1 is maintained, operate the pressure variable device 7 to change the canister-side pressure P2 with respect to the tank-side pressure P1 to the negative pressure side or the positive pressure side, thereby to form the pressure difference ΔP (for example, the specified value P0 or more). In a configuration in which the pump 71 is a negative pressure pump, the canister-side pressure P2 becomes a negative pressure. In a configuration in which the pump 71 is a positive pressure pump, the canister-side pressure P2 becomes a positive pressure.

Further, the pressure difference ΔP can also be formed by operating the pressure variable device 7 in a state where the sealing valve 3 is opened to change the canister-side pressure P2 and the tank-side pressure P1 to the negative pressure side or the positive pressure side (for example, the specified value P0 or more), subsequently, by closing the sealing valve 3 to maintain the changed tank-side pressure P1, and by opening the open/close valve 23 thereby release the canister-side pressure P2 to the atmosphere. In a configuration in which the pump 71 is a negative pressure pump, the tank-side pressure P1 becomes a negative pressure. In a configuration in which the pump 71 is a positive pressure pump, the tank-side pressure P1 becomes a positive pressure.

In this way, the tank-side pressure P1 or the canister-side pressure P2 is pressurized or depressurized to form a state in which the tank-side pressure P1 is higher or lower than the canister-side pressure P2. Thus, the pressure difference ΔP to learn the valve opening start position can be formed.

The relationship learning unit 54 learns in the learning operation 504 the relationship between multiple different values of the different tank-side pressure P1 and multiple different values of the valve opening start amount K0, when the valve opening start learning unit 52 learns the multiple different values of the valve opening start amount K0 corresponding to the multiple different values of tank-side pressure P1. Then, the relationship learning unit 54 is configured to create a pressure relationship map M1 showing the relationship between the valve opening start amount K0 and the tank-side pressure P1.

The opening degree correction unit 55 has a function to correct the dead zone. The opening degree correction unit 55 collates the in-operation pressure Pa to the pressure relationship map M1. The in-operation pressure Pa is the tank-side pressure P1 detected by using the tank pressure sensor 44 when the sealing valve 3 is opened to perform the vapor operation 501 or the purge operation 503. Then, the opening degree correction unit 55 reads an in-operation valve opening start amount Ka, which is the valve opening start amount K0 at this time, and corrects the opening degree command amount K1 of the opening degree command unit 51 by the in-operation valve opening start amount Ka.

(OPENING DEGREE COMMAND UNIT 51)

As shown in FIG. 2, the opening degree command unit 51 of the control device 5 transmits the opening degree command amount K1 to the stepping motor 35 of the sealing valve 3 during the vapor operation 501, the purge operation 503, and the learning operation 504. The opening degree command amount K1 is a predetermined number of drive pulses for driving the stepping motor 35. The opening degree command amount K1 from the opening degree command unit 51 is determined by the number of drive pulses for driving the stepping motor 35. The output shaft 351 of the stepping motor 35 rotates by a predetermined angle in response to each drive pulse transmitted to the stepping motor 35. Accordingly, the valve guide 32, the valve 33, and the valve-side spring 34 move by a predetermined amount in the axial direction L per drive pulse as well.

As shown in FIGS. 3 and 4, the opening degree of the sealing valve 3 is determined according to the number of pulses transmitted to the stepping motor 35. However, a dead zone exists in the sealing valve 3. The dead zone means that the valve 33 is actually closed even when the stepping motor 35 is energized in a step-like manner while the valve 33 of the sealing valve 3 is in the closed position 301. The dead zone is defined as the number of pulses that do not move the valve 33 from the position 301, in other words, an integrated value of the number of the pulse transmitted during which the sealing member 333 of the valve 33 does not separate from the sealing passage 311 and the tank-side pressure P1 does not begin to decrease. In addition, the number of pulses equal to the dead zone is represented as a valve opening start amount K0 of the sealing valve 3.

Figure 6:
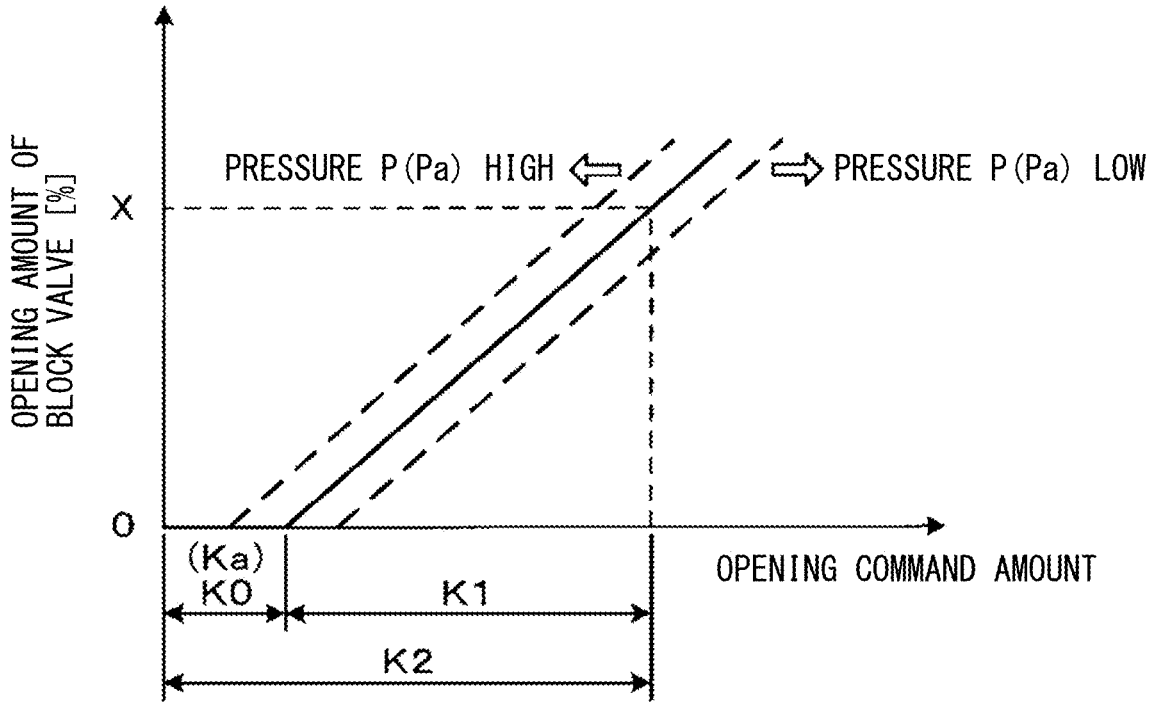
FIG. 6 is a graph showing a relationship between an opening degree command amount from a control device and an opening degree of a sealing valve according to the first embodiment.

As shown in FIG. 6, The valve opening start amount K0 compensates for the dead zone of the sealing valve 3. When the valve opening start amount K0 is added to the opening degree command amount K1 by the opening degree command unit 51, the opening degree command amount K1 can be used to proportionally change the opening degree of the sealing valve 3 from zero. During the vapor operation 501 and the purge operation 503, the opening degree command unit 51 determines the opening degree command amount K1 such that the vapor-phase gas G flows through the sealing valve 3 at the target flow rate.

At this time, the valve opening start amount K0 also changes depending on the tank-side pressure P1, and the relationship between the opening degree command amount K1 and the opening degree of the sealing valve 3 changes. Therefore, the valve opening start amount K0 can be regarded as an opening degree correction amount for correcting the opening degree command amount K1 with the opening degree command unit 51. In this case, the valve opening start amount K0 changes as the opening degree correction amount changes according to the tank-side pressure P1.

(PRESSURE RELATIONSHIP MAP M1)

Figure 7:
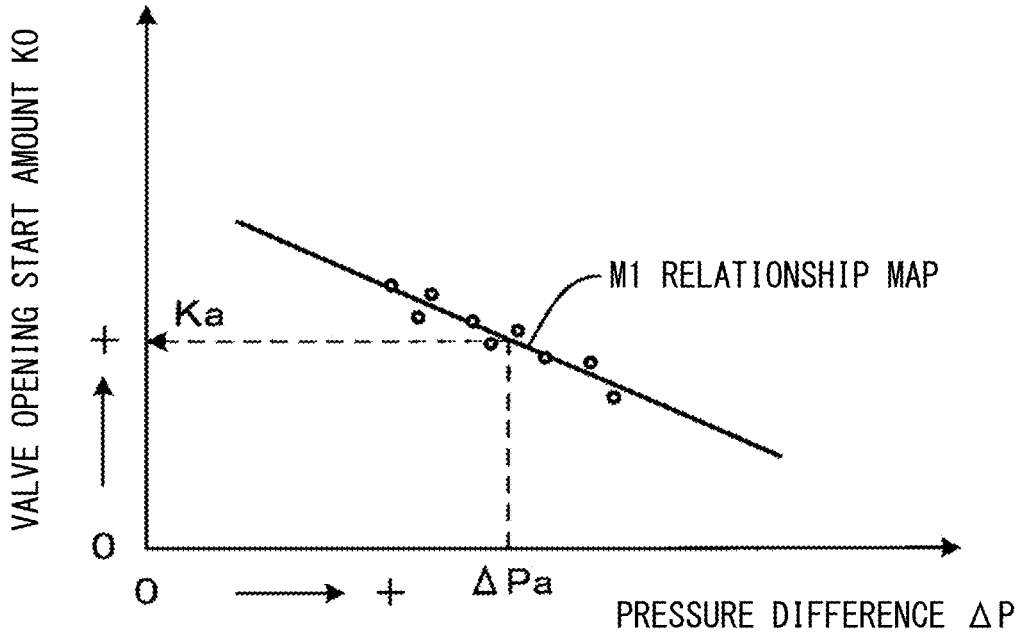
FIG. 7 is a graph showing a relationship map between a pressure of a vapor-phase gas and a valve opening start amount according to the first embodiment.

As shown in FIG. 7, in the pressure relationship map M1 between the valve opening start amount K0 and the tank-side pressure P1, the valve opening start amount K0 becomes smaller as the tank-side pressure P1 detected by using the tank pressure sensor 44 becomes higher. In other words, the higher the tank-side pressure P1 as detected, the larger the dead zone of the sealing valve 3, and the sealing valve 3 becomes more hardly opens. The pressure relationship map M1 is used to correct the opening degree command amount K1 by using the valve opening start amount K0 after the use of the vehicle 6 and the evaporated fuel processing device 1 is started. An initial map may also be created by repeatedly performing the learning operation 504 when or prior to the start of the use to learn the relationship between the valve opening start amount K0 and the tank-side pressure P1. After the start of the use, the valve opening start amount K0 may be learned, thereby to update the pressure relationship map M1 by performing the learning operation 504 in a timely manner.

(VALVE OPENING START LEARNING UNIT 52)

As shown in FIGS. 3 and 4, during the learning operation 504, when the valve 33 is in the closed position (initial position) 301, the opening start learning unit 52 of the control device 5 monitors two values: the opening degree command amount K1 transmitted from the opening degree command unit 51 to the stepping motor 35; and the tank-side pressure P1 received from the tank pressure sensor 44. Then, the opening start learning unit 52 learns the valve opening start amount K0 from the change in the opening degree command amount K1 and the tank-side pressure P1. Specifically, in a state where the pressure difference ΔP is the specified value P0 or more, the opening degree command amount K1 is gradually increased from zero. Then, when the magnitude of the change in the tank-side pressure P1 became equal to or more than a predetermined value, it is determined that the tank-side pressure P1 has changed. Then, the valve opening start learning unit 52 is configured to set the opening degree command amount K1 when the tank-side pressure P1 changes as the valve opening start amount K0.

For example, in the vapor operation 501, when the fuel tank 62 is purged to the canister 2, in a case where the flow rate of the vapor-phase gas G is too small, the purge of the vapor-phase gas G takes long time, and in a case where the flow rate of the gas phase gas G is too large, a large amount of evaporated fuel F1 in the vapor-phase gas G is adsorbed in the adsorbent 22. Therefore, it is necessary to accurately learn the valve opening start amount K0 corresponding to the dead zone of the sealing valve 3 and to set the opening degree of the sealing valve 3 appropriately. The learning operation 504 may be performed during the vapor operation 501 to open the vapor pipe by using the sealing valve 3 or the purge operation 503. Increase in the opportunity of the learning enables to learn the valve opening start amount K0 for multiple different values of the tank-side pressure P1, thereby to enable to reflect the valve opening start amount K0 on the pressure relationship map M1.

The learning operation 504 may be performed when the internal combustion engine 61 is stopped or started. When the internal combustion engine 61 is stopped, for example, the vapor operation 501 is performed when the vehicle is stopped and refueled. Further, when the ignition switch is turned on at the start of operation to start the operation, the vapor operation 501 may be performed for the learning operation 504 to learn the valve opening start amount K0. In these cases, the vehicle 6 is stopped, and therefore, the influence of the pressure fluctuation due to the traveling of the vehicle can be suppressed. The learning operation 504 may also be performed when the sealing valve 3 is to be opened to perform the purge operation 503 during traveling, thereby to enable to increase the opportunity of the learning. The learning operation 504 may also be performed during the leak check operation by the leak check module 70. This will be described later in detail.

Specifically, the valve opening start learning unit 52 is configured to determine that the tank-side pressure P1 has changed when the magnitude (absolute value) of the change amount ΔP1 of the tank-side pressure P1 due to the start of the learning operation 504 becomes equal to or higher than the predetermined valve opening threshold TH. The valve opening threshold TH is set to a value that enables detection of a pressure change caused by the valve 33 of the sealing valve 3 that moves away from the closed position, in consideration of a variation in the detected value of the tank-side pressure P1 and the like. The tank-side pressure P1 changes such that the tank-side pressure P1 becomes higher when the tank-side pressure P1 is lower due to the pressure difference ΔP formed by the pressure difference forming unit 53. The tank-side pressure P1 changes such that the tank-side pressure P1 becomes lower when the tank-side pressure P1 is higher.

(PRESSURE DIFFERENCE FORMING UNIT 53)

The pressure difference forming unit 53 forms a state in which the tank-side pressure P1 and the canister-side pressure P2 have the predetermined pressure difference ΔP prior to the learning operation 504 with the valve opening start learning unit 52. The tank-side pressure P1 becomes higher than the canister-side pressure P2 in an environment where the outside air temperature is high or the temperature of the fuel tank 62 increases due to the operation of the internal combustion engine 61. Alternatively, the tank-side pressure P1 becomes gradually higher in an environment where the ambient temperature of the fuel tank 62 is high. However, in a condition where an environment in which the ambient temperature is low continues when the internal combustion engine 61 is operated infrequently in, such as an HV or a PHV, the pressure difference ΔP is not sufficiently formed, and therefore, a state suitable for learning of the valve opening start learning unit 52 is hardly made.

Even in such a case, the pressure difference forming unit 53 uses the pump 71 provided in the canister 2 to change the pressure in the evaporated fuel flow path including the canister 2 to form the pressure difference ΔP that is the specified value P0 or more. It is desirable that the specified value P0 is set to a value larger than the valve opening threshold value T that is for determining the change in the tank-side pressure P1. As the formed pressure difference ΔP becomes larger, the pressure change caused by the start of the valve opening of the sealing valve 3 can be detectable more quickly.

Figure 8:
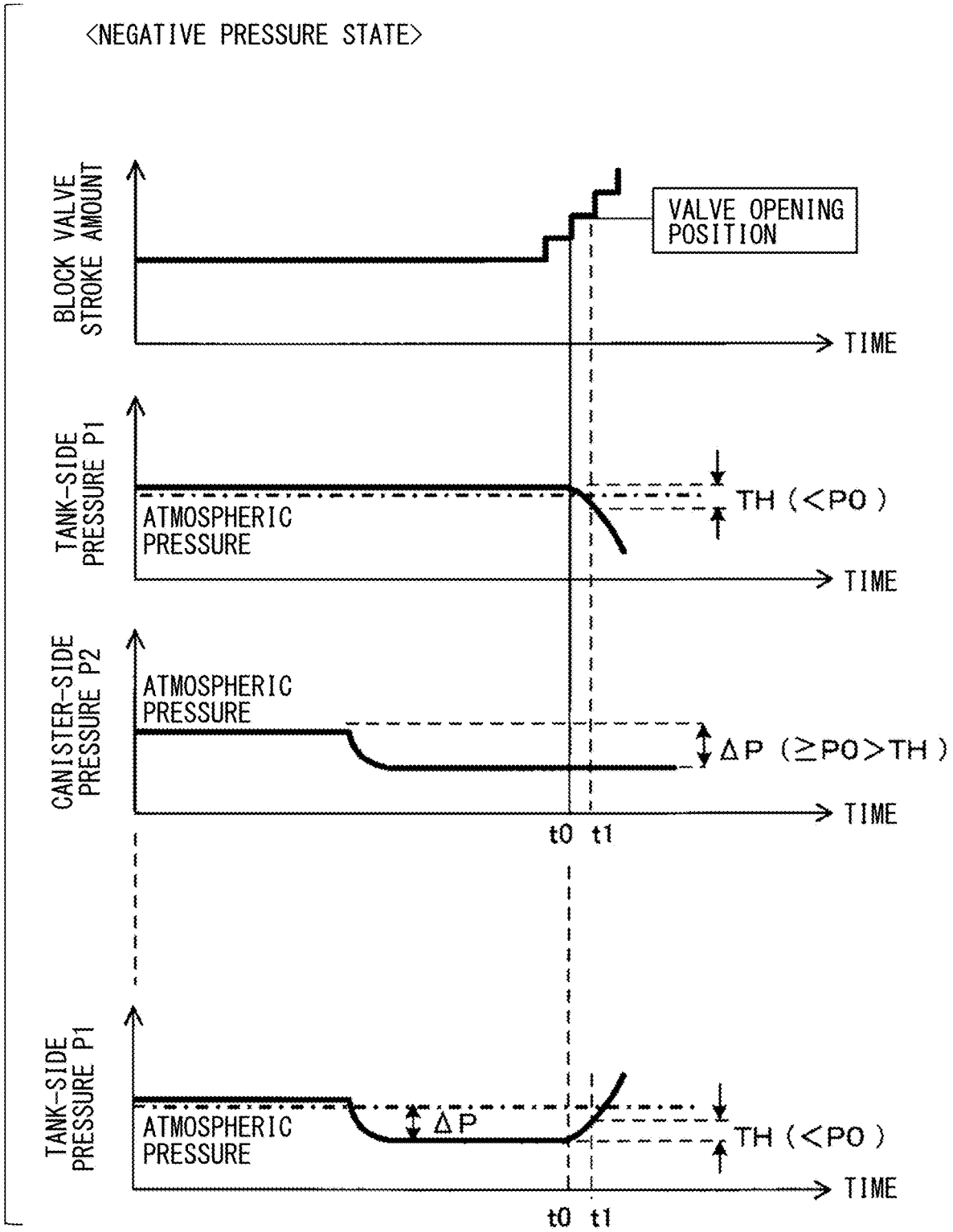
FIG. 8 is a time chart showing a learning operation performed in a state where a pressure difference (at the time of negative pressure) by using the control device is made according to the first embodiment.

As shown in FIG. 8, for example, in a state where the sealing valve 3 is closed, the pump 71 is operated to form a negative pressure in the canister 2 and in the evaporated fuel flow path that communicates with the canister 2, thereby to enable to form the pressure difference ΔP with respect to the tank-side pressure P1 in the fuel tank 62. At this time, even when the tank-side pressure P1 is substantially atmospheric pressure, the pressure difference ΔP corresponding to the magnitude of the negative pressure formed by the leak check module 70 can be obtained.

By using this pressure difference ΔP, the valve opening start learning unit 52 enables to perform the learning operation 504 to learn the valve opening start position. In that case, from the state where the sealing valve 3 is closed, the stroke amount of the valve 33 corresponding to the opening degree command amount K1 of the sealing valve 3 is gradually increased, and when the pressure change amount ΔP1 with respect to the tank-side pressure P1 before the start of learning becomes equal to or higher than the valve opening threshold value TH, it may be determined as the valve opening start position.

In this case, the pressure difference ΔP is formed such that the tank-side pressure P1 becomes higher than the canister-side pressure P2, and the pressure in the fuel tank 62 is decreased due to the valve 33 that moves away from the closed position 301 at the time point t0. The pressure difference ΔP is set to be equal to or higher than the specified value P0, which is larger than the valve opening threshold TH. Therefore, the vapor-phase gas G in the fuel tank 62 is promptly released toward the canister 2 when the valve 33 is separated from the closed position 301. In this way, the pressure change amount ΔP1 is increased to reach the valve opening threshold value TH at the time point t1. The opening degree command amount K1 corresponding to the pressure change amount ΔP1 at this time may be stored as the learning value of the valve opening start amount K0.

Therefore, a state where an environment inside and outside the fuel tank 62 is not suitable for increasing the tank-side pressure P1 and where the pressure inside of the fuel tank 62 remains almost unchanged from the atmospheric pressure continues, the predetermined pressure difference ΔP is formed by changing the canister-side pressure P2, thereby to enable to increase the learning opportunity and to accurately learn the valve opening start amount K0.

Further, the pressure difference forming unit 53 may introduce a negative pressure formed in the canister 2 into the fuel tank 62 by opening the sealing valve 3 to set the tank-side pressure P1 to a negative pressure and then may close the sealing valve 3 to open the inside of the canister 2 to the atmosphere, thereby to form the pressure difference ΔP. The pressure difference ΔP at this time also has a magnitude corresponding to the negative pressure formed by the leak check.

As shown in the lowermost stage in FIG. 8, in this case, the pressure difference ΔP is formed such that the tank-side pressure P1 becomes lower than the canister-side pressure P2 which is the atmospheric pressure. In that case, the pressure in the fuel tank 62 increases by causing the valve 33 to move away from the closed position 301. Also in this case, the pressure difference ΔP is set to be equal to or higher than the specified value P0, which is larger than the valve opening threshold TH. Therefore, the vapor-phase gas G in the fuel tank 62 flows in from the side of the canister 2 when the valve 33 is separated from the closed position 301, and the pressure difference ΔP reaches the valve opening threshold vale TH. The opening degree command amount K1 corresponding to the pressure change amount ΔP1 at this time may be stored as the learning value of the valve opening start amount K0.

Figure 9:
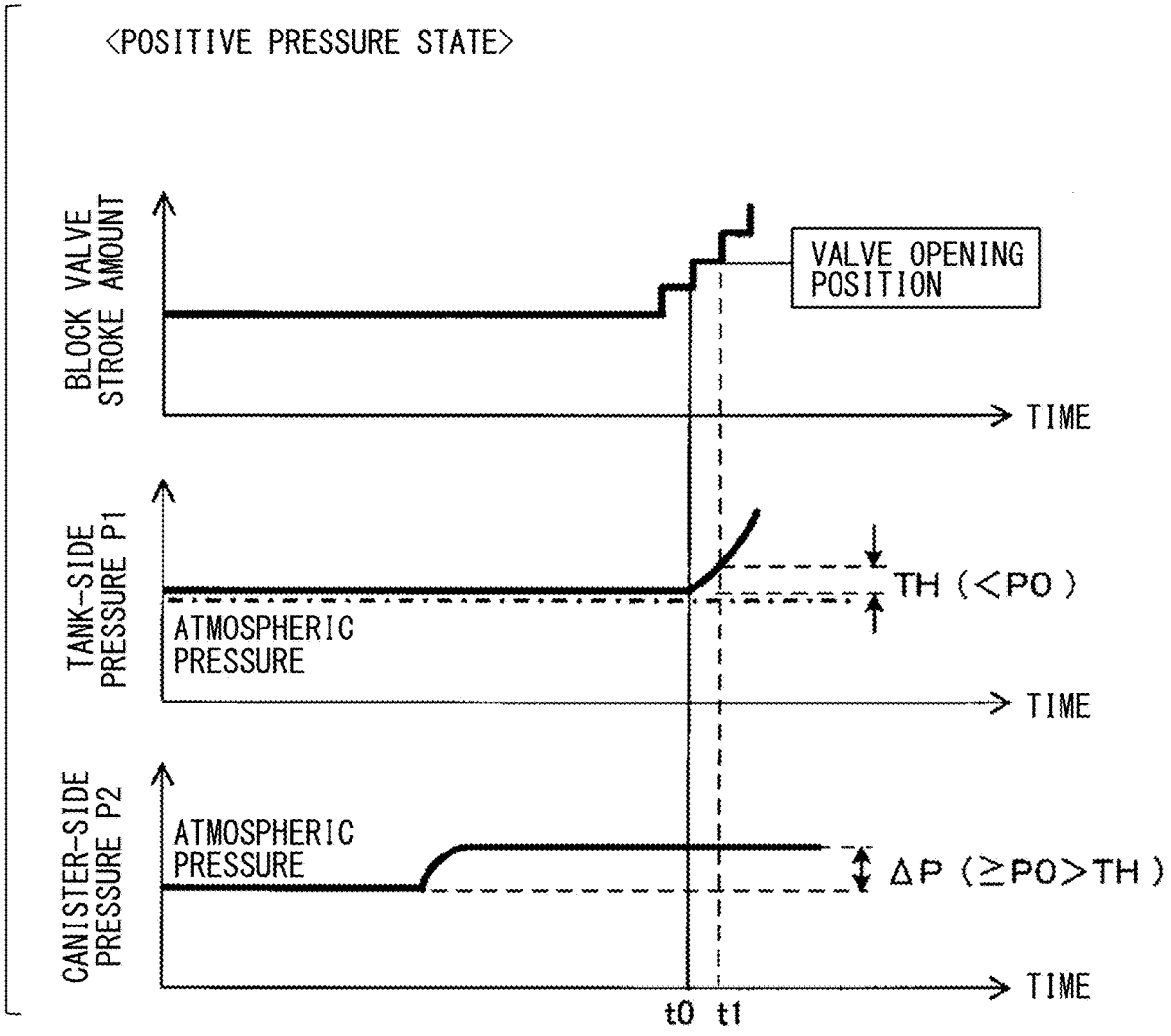
FIG. 9 is a time chart showing a learning operation performed in a state where a pressure difference (at the time of positive pressure) by using the control device is made according to the first embodiment.

As shown in FIG. 9, even in a configuration in which the pump 71 is a positive pressure pump, the pressure difference ΔP can be formed by the same operation by utilizing the positive pressure formed in the canister 2. That is, when the pressure inside the canister 2 is set to a positive pressure in a state where the sealing valve 3 is closed, relatively, the tank-side pressure P1 becomes low, and the valve opening start amount K0 can be learned in the same manner as in the lowermost stage of FIG. 8. Further, when the positive pressure formed in the canister 2 is released into the fuel tank 62 by opening the sealing valve 3, and then the inside of the canister 2 is opened to the atmosphere, the tank-side pressure P1 becomes high (not shown), and the valve opening start amount K0 can be learned in the same manner as the relationship shown on the upper side in FIG. 8.

(RELATIONSHIP LEARNING UNIT 54)

As shown in FIG. 6, the relationship learning unit 54 of the control device 5 is provided so that, after use of the vehicle 6 and the evaporative fuel processing device 1 are started, the opening degree command unit 51 is configured to correct the opening degree command amount K1 based on the tank-side pressure P1. The relationship learning unit 54 learns the relationship between the valve opening start amount K0 and the tank-side pressure P1 for different values of the tank-side pressure P1 in a state where the valve 33 is in the closed position 301 by using the valve opening start amount K0 that is learned by the valve opening start learning unit 52. Then, relationship learning unit 54 is configured to create or update the pressure relationship map M1 between the valve opening start amount K0 and the tank-side pressure P1.

As shown in FIGS. 3 and 4, the tank-side pressure P1 acting on the inflow portion 312 of the sealing passage 311 is higher than the pressure in the canister 2 acting on the outflow portion 314 of the sealing passage 311. A net pressure acts on the valve 33 that biases the valve 33 toward the proximal side L2 in the axial direction L. Then, as the tank-side pressure P1 increases, the net pressure, which biases the valve 33 toward the proximal side L2 in the axial direction L, also increases. For this reason, the valve opening start amount K0 of the open/close valve 23 detected by the valve opening start learning unit 52 becomes smaller as the tank-side pressure P1 increases.

(OPENING DEGREE CORRECTION UNIT 55)

As shown in FIG. 6, the opening degree correction unit 55 of the control device 5 corrects the opening degree command amount K1 from the opening degree command unit 51 by taking the valve opening start amount K0 into consideration. As a result, even in a configuration where the opening degree of the sealing valve 3 is not directly measured, the opening degree correction unit 55 enables to correct an error factor caused by the dead zone of the sealing valve 3, such that the opening degree of the sealing valve 3 matches the target opening degree. This configuration enables to control the flow rate of the vapor-phase gas G passing through the sealing valve 3 at an appropriate flow rate.

As shown in FIG. 7, the opening degree correction unit 55 uses the pressure relationship map M1 between the valve opening start amount K0 and the tank-side pressure P1 when performing both the vapor operation 501 and the purge operation 503. Then, the opening degree correction unit 55 corrects the opening degree command amount K1 by using the opening degree command unit 51. When performing the vapor operation 501 and the purge operation 503, the opening degree correction unit 55 detects the in-operation pressure Pa, which is the tank-side pressure P1 when the sealing valve 3 opens the vapor pipe 41, by using the tank pressure sensor 44.

Next, the opening degree correction unit 55 collates the in-operation pressure Pa to the pressure relationship map M1 and reads the operating valve opening amount Ka, which is the valve opening start amount K0 corresponding to the in-operation pressure Pa. Next, when the opening degree command unit 51 transmits the opening degree command amount K1 to the stepping motor 35 of the sealing valve 3, the opening degree correction unit 55 adds the amount Ka to the opening degree command K1 in order to correct the opening degree command amount K1. In other words, the opening degree correction unit 55 changes the number of pulses indicated by the opening degree command amount K1 transmitted from the opening degree command unit 51 to the stepping motor 35 to a number of pulses obtained by adding the number of pulses corresponding to the opening degree command amount K1 to the number of pulses corresponding to the amount Ka.

In this way, as shown in FIG. 6, the opening degree correction unit 55 adds the operating valve opening start amount Ka to the opening degree command amount K1, which is based on a target opening degree for the opening degree of the sealing valve 3, thereby to obtain a corrected opening degree command amount K2. Further, during the vapor operation 501 and the purge operation 503, when the vapor pipe 41 is opened by the sealing valve 3, the opening degree command unit 51 sends the corrected opening degree command amount K2 to the stepping motor 35 of the sealing valve 3, thereby to set the opening degree of the sealing valve 3.

(CONTROL OF EVAPORATED FUEL PROCESSING DEVICE 1)

As shown in FIG. 1, in the vehicle 6, when the control device 5 performs the sealing operation such that the opening degree of the sealing valve 3 is zero and the valve 33 closes the sealing passage 311 of the housing 31, the vapor pipe 41 that connects the fuel tank 62 to the canister 2 is closed. Then, the tank-side pressure P1 is appropriately increased. Hereinafter, the learning operation 504, the vapor operation 501, the canister purge operation 502, and the purge operation 503 will be described with reference to flowcharts.

(LEARNING OPERATION 504)

Figure 10:
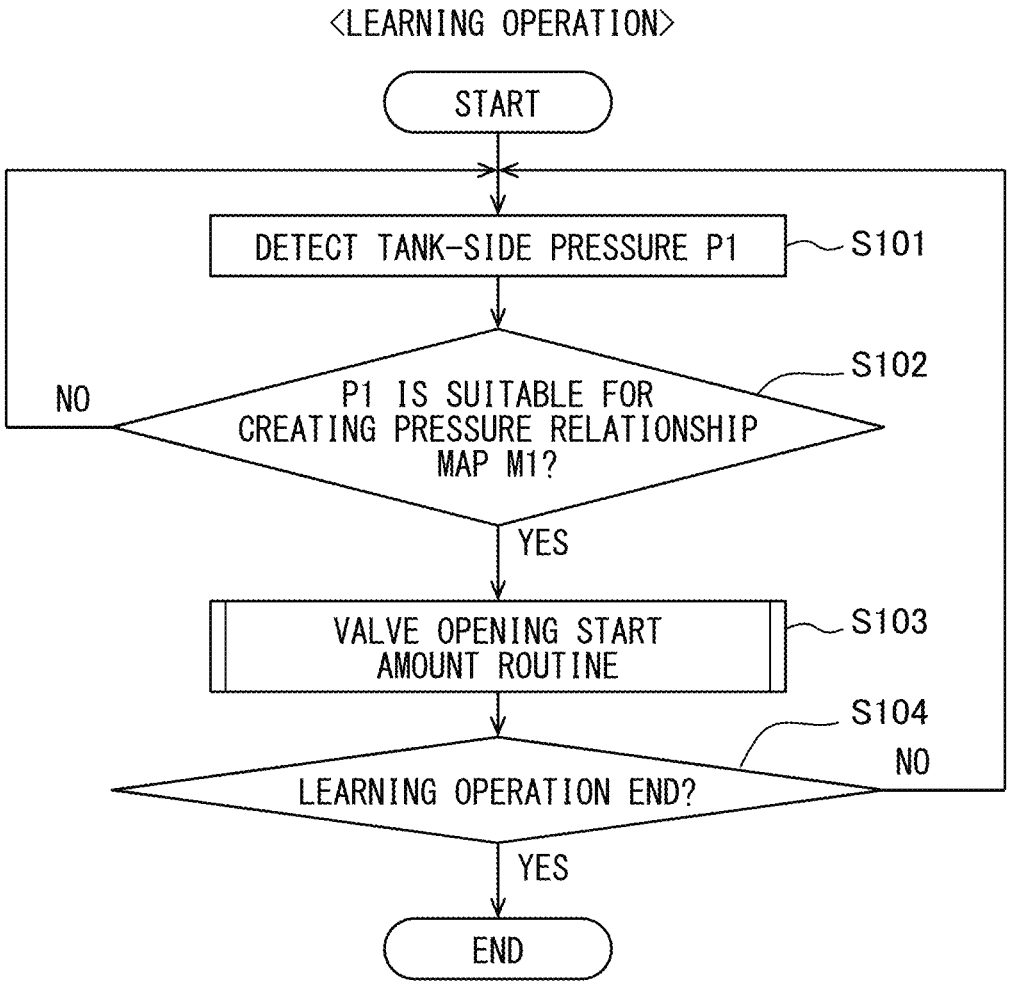
FIG. 10 is a flowchart illustrating the learning operation according to the first embodiment.

As shown in the flowcharts of FIG. 10, when the opening of the sealing valve 3 is zero, the control device 5 performs the learning operation 504. In the learning operation 504, the tank pressure sensor 44 detects the tank-side pressure P1 (step S101). Then, the relationship learning unit 54 of the control device 5 determines whether or not the detected tank-side pressure P1 is suitable for creating the pressure relationship map M1 (step S102). This determination is performed to obtain the relationships between multiple values of the tank-side pressure P1 and corresponding values of the valve opening start amount K0 for the pressure relationship map M1.

When the detected tank-side pressure P1 is suitable for creating the pressure relationship map M1, a valve opening start amount routine is executed with the valve opening start learning unit 52 of the control device 5 (step S103). When it is determined that the tank-side pressure is not suitable for creating the pressure relationship map M1, the detection of the tank-side pressure P1 is repeated (step S101).

Figure 11:
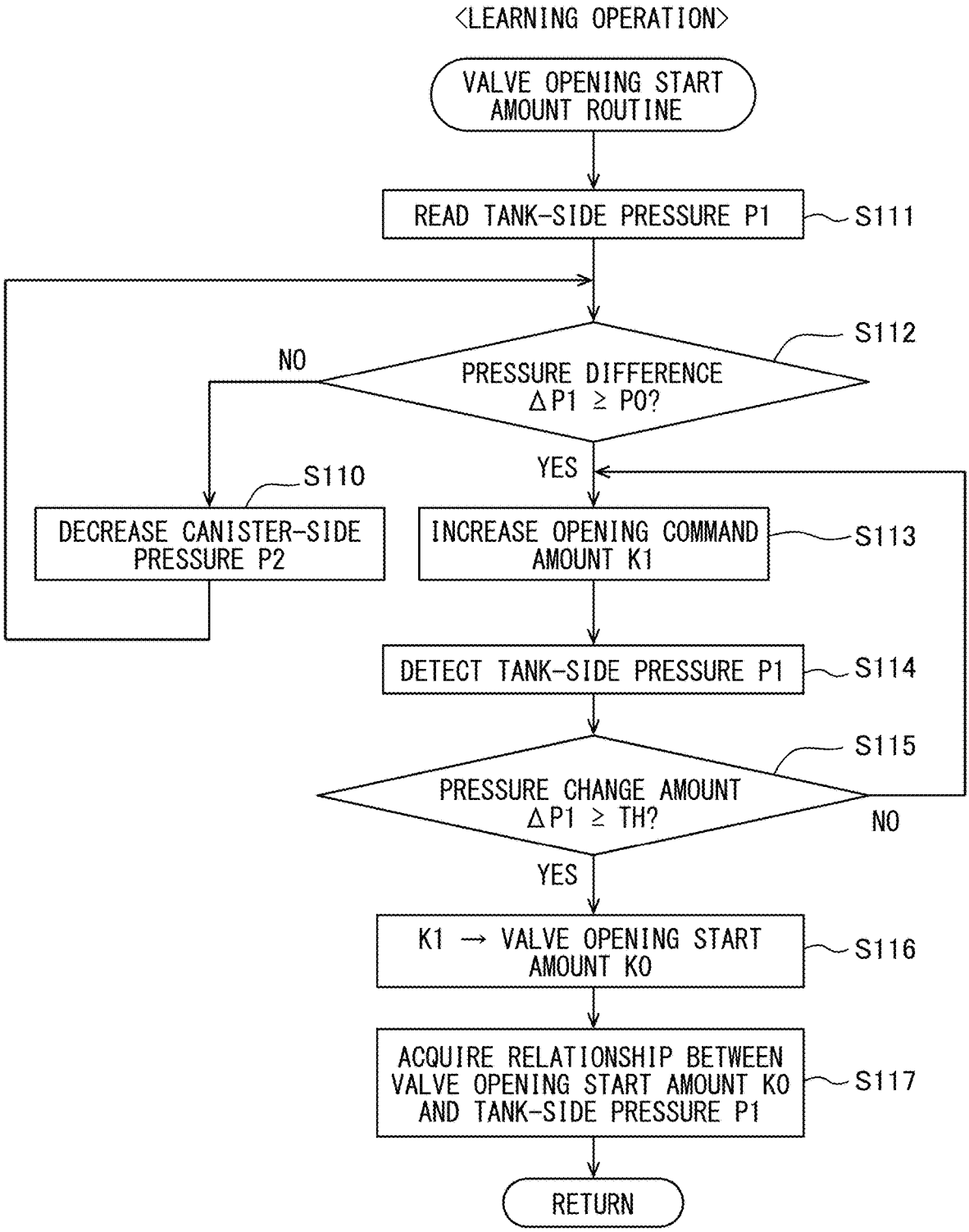
FIG. 11 is a flowchart illustrating the learning operation according to the first embodiment.

As shown in the flowchart of FIG. 11, in the valve opening start amount routine, first, the tank-side pressure P1, which is detected in a state where the opening degree command amount K1 of the opening degree command unit 51 of the control device 5 is set to zero, is read. (Step S111). The tank-side pressure P1 is, for example, the tank-side pressure P1 detected in step S101.

Next, based on the detected tank-side pressure P1, it is determined whether or not the pressure difference ΔP, which is the difference from the canister-side pressure P2, is in a state of the specified value P0 or more (step S112). Herein, based on the detected tank-side pressure P1, it is determined whether or not the pressure difference ΔP from the canister-side pressure P2 is estimated to be the specified value P0 or more. Normally, the canister-side pressure P2 is the atmospheric pressure, and therefore, when the tank-side pressure P1 is higher than a value that considers a variation in the atmospheric pressure by the specified value P0 or more, the pressure difference ΔP can be estimated to be the specified value P0 or more.

When it is determined that the pressure difference ΔP is less than the specified value P0, subsequently, the pressure difference forming unit 53 of the control device 5 operates the pump 71 of the leak check module 70 to reduce the canister-side pressure P2. (Step S110). As shown in FIG. 8, in this case, the pressure difference ΔP that is the specified value P0 or more can be formed by setting the canister-side pressure P2 to a negative pressure while the tank-side pressure P1 is maintained. After that, it is determined whether or not the pressure difference ΔP is equal to or more than the specified value P0. When the pressure difference ΔP is determined to be the specified value P0 or more, the opening degree command amount K1 is increased by a predetermined amount (step S113).

Next, the tank pressure sensor 44 detects the tank-side pressure P1 (step S114). Further, the valve opening start learning unit 52 of the control device 5 compares the pressure change amount ΔP1 with the valve opening threshold value TH and determines whether or not the pressure change amount ΔP1 is equal to or higher than the valve opening threshold value TH (step S115). The pressure change amount ΔP1 is a value obtained by subtracting the detected tank-side pressure P1 from the tank-side pressure P1 that is read in step S111 and is a pressure decrease amount here.

When ΔP1≥TH is satisfied, it is determined that the tank-side pressure P1 has started to decrease, and the opening degree command amount K1 at this time is set as the valve opening start amount K0 (step S116). When ΔP<TH is satisfied, it is determined that the decrease in the tank-side pressure P1 has not started yet. In this case, the opening degree command amount K1 is increased, and the pressure change amount ΔP1 is repeatedly compared with the valve opening threshold TH (step S113 to 115).

In this way, the valve opening start position is learned based on the pressure decrease amount ΔP of the tank-side pressure P1, and the relationship between the valve opening start amount K0 and the tank-side pressure P1 is obtained as a part of the pressure relationship map M1 (step S116).

Subsequently, as shown in the flowchart of FIG. 10, the detection of the tank-side pressure P1 by using the tank pressure sensor 44 is continued (step S101). In addition, the relationship learning unit 54 determines whether or not the detected tank-side pressure P1 is suitable for creating the pressure relationship map M1 (step S102). Then, when multiple values of the different tank-side pressure P1 are detected, the valve opening start amount routine is repeatedly performed (steps S103, S111 to S116).

In this way, until the learning operation 504 is completed (step S104), the relationship between the valve opening start amount K0 and the tank-side pressure P1 is obtained in an appropriate range of the tank-side pressure P1 (step S116), and the pressure relationship map M1 between the valve opening start amount K0 and the tank-side pressure P1 is created.

In a configuration where the pump 71 of the leak check module 70 is a positive pressure pump, the canister-side pressure P2 can be increased with respect to the tank-side pressure P1. As shown in FIG. 9, in this case, the pressure difference ΔP that is the specified value P0 or more can be formed by increasing the canister-side pressure P2 while the tank-side pressure P1 is maintained.

Alternatively, in a configuration in which the pump 71 of the leak check module 70 is a negative pressure pump or a positive pressure pump, the canister-side pressure P2 may be changed, and subsequently, the sealing valve 3 may be opened to form the same pressure as the canister-side pressure P2. Further, the sealing valve 3 may be closed, and the switching valve 73 (open/close valve 23) may be opened. In this way, the pressure difference ΔP that is the specified value P0 or more can be formed. In this case, as shown in FIG. 9, the tank-side pressure P1 becomes a negative pressure or a positive pressure according to the pump 71, and the relationship between the changed tank-side pressure P1 and the valve opening start amount K0 is acquired.

(VAPOR OPERATION 501)

An occupant of the vehicle 6 presses a refueling switch provided in the vehicle compartment prior to refueling the fuel tank 62 with the fuel F. The operation of the refueling switch is interpreted as the start of the vapor operation, and the vapor operation 501 is performed by the control device 5. At this time, the opening degree correction unit 55 uses the pressure relationship map M1 to correct the opening degree command amount K1 from the opening degree command unit 51.

Figure 12:
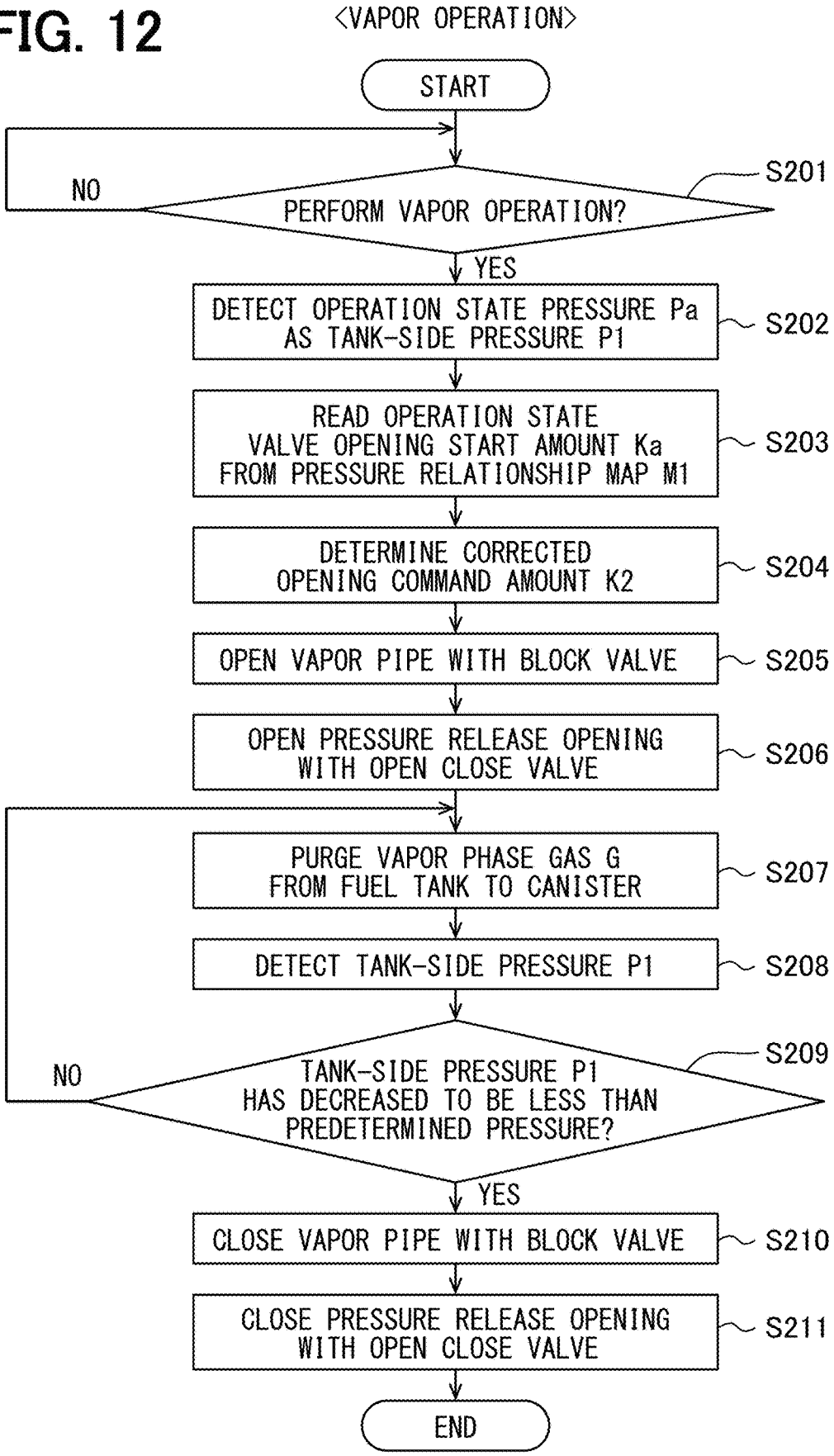
FIG. 12 is a flowchart illustrating a vapor operation according to the first embodiment.

Specifically, as shown in the flowchart of FIG. 12, it is determined whether or not to perform the vapor operation 501 based on the presence or absence of the input of the refueling switch (step S201). When the refueling switch is pressed, an in-operation time is recognized, and the in-operation pressure Pa as the tank-side pressure P1 in the in-operation time is detected by using the tank pressure sensor 44 (step S202).

Next, as shown in FIG. 6, the in-operation pressure Pa is collated with the pressure relationship map M1, and the in-operation valve opening start amount Ka, which is the valve opening start amount K0 corresponding to the in-operation pressure Pa, is read from the pressure relationship map M1 (step S203). Then, as shown in FIG. 5, the opening degree command amount K1 from the opening degree command unit 51 is used to compute the corrected opening degree command amount K2 (step S204). Specifically, the corrected opening degree command amount K2 is computed by adding the in-operation valve opening start amount Ka to the opening degree command amount K1 corresponding to the target opening degree. The target opening degree is determined according to a target flow rate for the vapor-phase gas G to be purged from the fuel tank 62 to the canister 2.

Next, the corrected opening degree command amount K2 is transmitted from the opening degree command unit 51 to the stepping motor 35 of the sealing valve 3, and the vapor pipe 41 is opened by using the sealing valve 3 (step S205). Further, in response to a command received from the control device 5, the pressure release port 213 is opened by the open/close valve 23 of the canister 2 (step S206). In this way, the vapor-phase gas G flowing through the sealing valve 3 is controlled to flow at the target flow rate, and the vapor-phase gas G is purged from the fuel tank 62 to the canister 2 through the vapor pipe 41 (step S207). At this time, the gas in the fuel tank 62 flows to the canister 2 due to the difference between the pressure P caused by the vapor-phase gas G and the like in the fuel tank 62 and the pressure in the canister 2. As a result, the fuel components of the evaporated fuel F1 contained in the vapor-phase gas G are adsorbed by the adsorbent 22 in the canister 2.

Thereafter, the tank-side pressure P1 is detected by using the tank pressure sensor 44 (step S208), and it is determined whether or not the tank-side pressure P1 has decreased below a predetermined pressure (step S209). When the tank-side pressure P1 has decreased to the predetermined pressure or less, the vapor pipe 41 is closed by the sealing valve 3 (step S210). In addition, the pressure release port 213 of the canister 2 is closed by the open/close valve 23 (step S211). In this way, the vapor operation 501 is completed, and the fuel supply port 621 is opened by the control device 5 to enable an occupant of the vehicle 6 to supply fuel into the fuel tank 62 from the fuel supply port 621.

In addition, when an occupant of the vehicle 6 or the like supplies fuel F to the fuel tank 62, the sealing valve 3 may open the vapor pipe 41, and the open/close valve 23 may open the pressure release port 213 of the canister 2.

(CANISTER PURGE OPERATION 502)

A canister purge operation 502 is a process in which, while the internal combustion engine 61 is performing the combustion operation, the fuel components adsorbed by the adsorbent 22 of the canister 2 are purged to the intake pipe 611 of the internal combustion engine 61. The timing at which the canister purge operation 502 is performed is appropriately determined by the control device 5.

Figure 13:
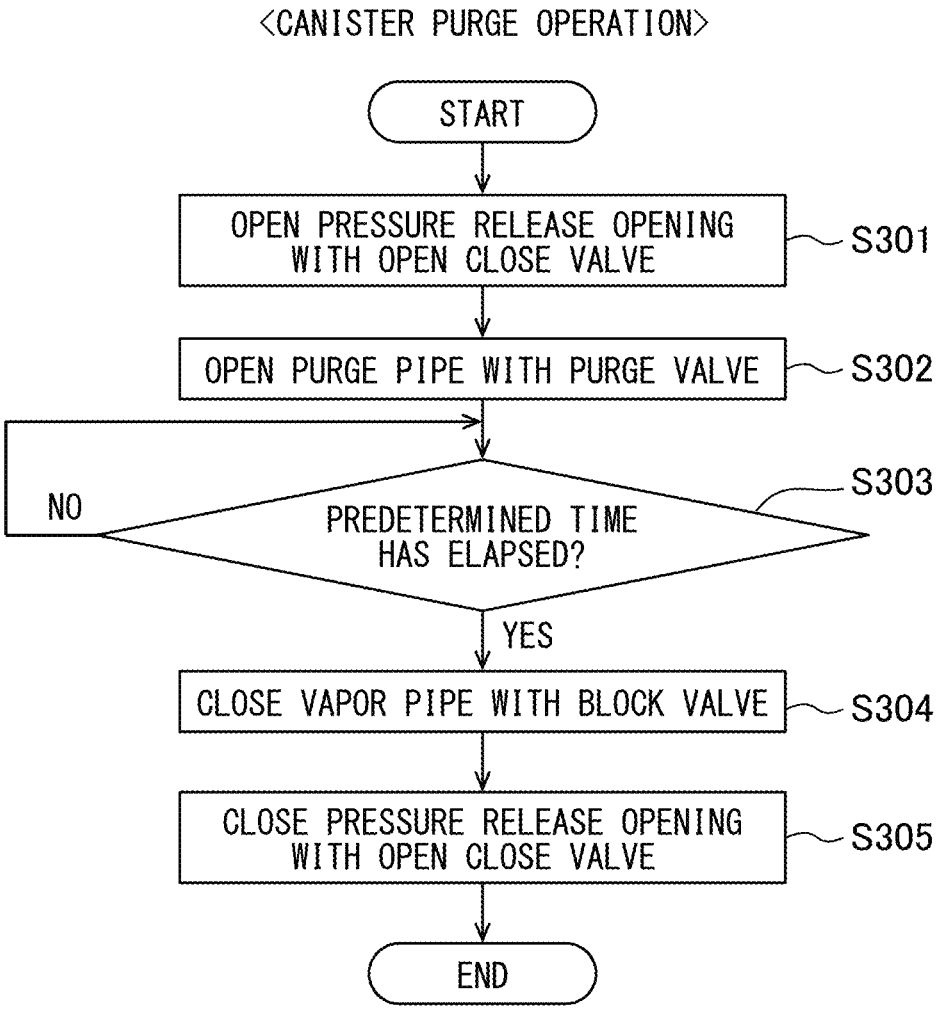
FIG. 13 is a flowchart illustrating a canister purge operation according to the first embodiment.

Specifically, as shown in the flowchart in FIG. 13, the fuel component adsorbed by the adsorbent 22 is purged from the canister 2 to the intake pipe 611 of the internal combustion engine 61, the pressure release port 213 of the canister 2 is opened by the open/close valve 23 (step S301), and the purge pipe 42 is opened by the purge valve 43 (step S302).

At this time, the canister 2 is connected to the intake pipe 611 of the internal combustion engine 61 through the purge pipe 42. The fuel component in the adsorbent 22 flows to the intake pipe 611 due to the difference between the pressure in the canister 2 (atmospheric pressure) and the pressure in the intake pipe 611 (negative pressure) of the internal combustion engine 61. The fuel component released from the adsorbent 22 is used for the combustion of the internal combustion engine 61 together with the fuel F injected into the internal combustion engine 61.

Next, it is determined whether a predetermined time has elapsed since the open/close valve 23 and the purge valve 43 were opened (step S303). After the predetermined amount of time has elapsed, the pressure release port 213 of the canister 2 is closed by the open/close valve 23 (step S304), and the purge pipe 42 is closed by the purge valve 43 (step S305). In this way, the canister purge operation 502 is completed, and the fuel component adsorbed by the adsorbent 22 of the canister 2 is used for the combustion operation of the internal combustion engine 61.

(PURGE OPERATION 503)

Figure 14:
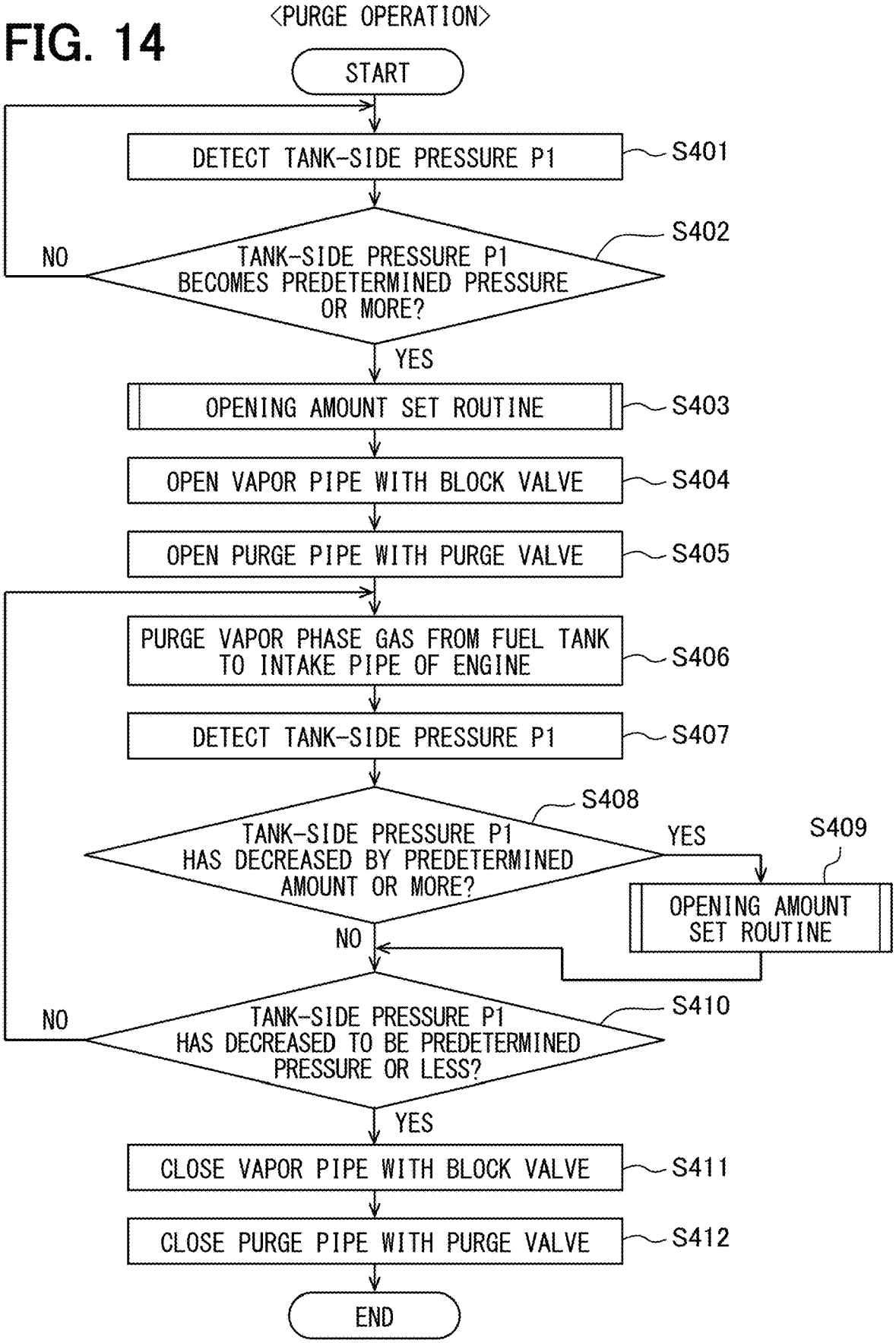
FIG. 14 is a flowchart illustrating a purge operation according to the first embodiment.

As shown in the flowchart of FIG. 14, while the internal combustion engine 61 is performing the combustion operation, the fuel tank 62 is normally closed by the sealing valve 3. In this state, the tank pressure sensor 44 of the fuel tank 62 continuously detects the tank-side pressure P1 (step S401). In addition, it is determined whether or not the tank-side pressure P1 has reached or exceeded a predetermined pressure (step S402). When the tank-side pressure P1 reaches the predetermined pressure or more, it signals a purge operation time, and the purge operation 503 is executed by the control device 5.

Figure 15:
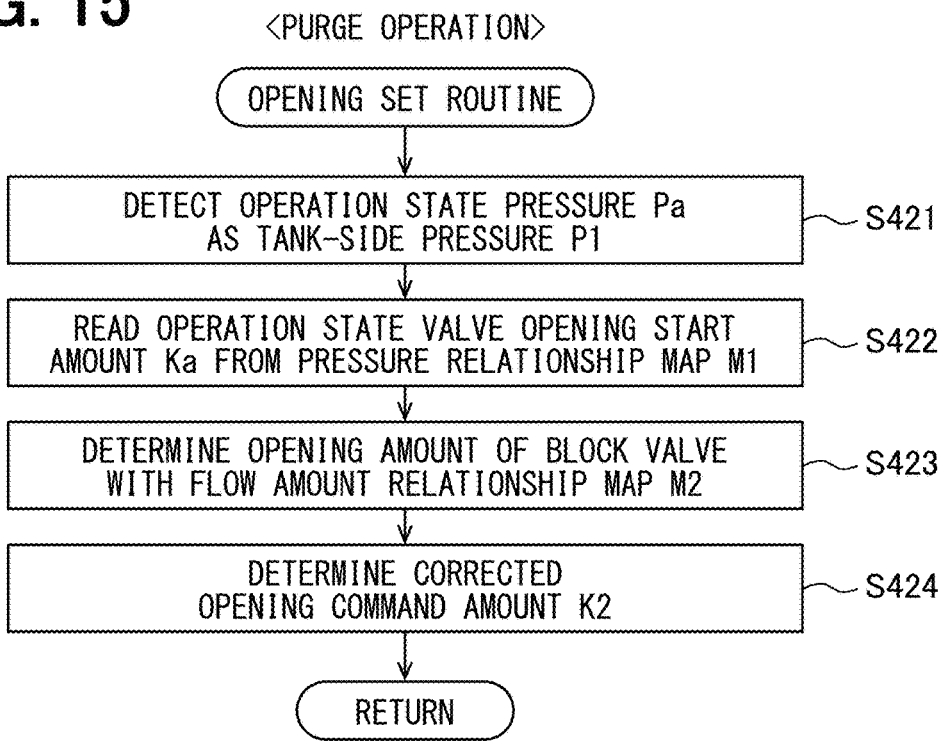
FIG. 15 is a flowchart illustrating the purge operation according to the first embodiment.

Specifically, an opening degree setting routine (step S403) is executed. As shown in the flowchart in FIG. 15, in the opening degree setting routine, the in-operation pressure Pa as the tank-side pressure P1 in the in-operation time is detected by using the tank pressure sensor 44 (step S421). Next, as shown in FIG. 6, the in-operation pressure Pa is collated with the pressure relationship map M1, and the in-operation valve opening start amount Ka, which is the valve opening start amount K0 corresponding to the in-operation pressure Pa, is read from the pressure relationship map M1 (step S422).

Next, the opening degree of the sealing valve 3 for producing the target flow rate is determined based on the tank-side pressure P1 and the target flow rate of vapor-phase gas G flowing through the sealing valve 3 (step S423). reference The target flow rate of the vapor-phase phase gas G flowing through the sealing valve 3 is set to a flow rate suitable for controlling the air-fuel ratio of the internal combustion engine 61. Then, as shown in FIG. 5, the opening degree command amount K1 from the opening degree command unit 51 is used to compute the corrected opening degree command amount K2 (step S424). Specifically, the corrected opening degree command amount K2 is computed by adding the in-operation valve opening start amount Ka to the opening degree command amount K1 corresponding to the opening degree of the sealing valve 3.

Next, the corrected opening degree command amount K2 is transmitted from the opening degree command unit 51 to the stepping motor 35 of the sealing valve 3, and the vapor pipe 41 is opened by using the sealing valve 3 (step S404). Further, in response to a command received from the control device 5, the purge pipe 42 is opened by the purge valve 43 (step S405). Note that the vapor pipe 41 may be opened by the sealing valve 3 after the purge pipe 42 is opened by the purge valve 43. Further, when the purge pipe 42 is opened by the purge valve 43, the pressure release port 213 of the canister 2 may be opened by the open/close valve 23.

In this way, the vapor-phase gas G flowing through the sealing valve 3 and the purge valve 43 is controlled to flow at the target flow rate. The vapor-phase gas G from the vapor-phase gas G in the fuel tank 62 is purged into the intake pipe 611 of the internal combustion engine 61 through the vapor pipe 41 and the purge pipe 42 (step S406). At this time, the gas in the fuel tank 62 flows to the intake pipe 611 of the internal combustion engine 61 due to the difference between the pressure caused by the vapor-phase gas G in the fuel tank 62 and the pressure in the intake pipe 611.

Further, the injected fuel F2 is supplied by the fuel injection device 63, and a feedback control is performed by the control device 5, such that the air-fuel ratio becomes the target air-fuel ratio, for the internal combustion engine 61 before the purge operation 503 and the canister purge operation 502 are performed to purge the vapor-phase gas G from the evaporative fuel processing device 1 to the intake pipe 611.

Subsequently, the tank-side pressure P1 is detected by using the tank pressure sensor 44 (step S407), and it is determined whether or not the tank-side pressure P1 has decreased by a predetermined amount or more (step S408). When the tank-side pressure P1 has decreased by the predetermined amount or more, the opening degree setting routine (step S409) is executed again.

In addition, when the tank-side pressure P1 is detected by using the tank pressure sensor 44, it is determined whether or not the tank-side pressure P1 has decreased below a predetermined pressure (step S410). When the tank-side pressure P1 has decreased to the predetermined pressure or less, the vapor pipe 41 is closed by the sealing valve 3 (step S411). Further, the purge pipe 42 is closed by the purge valve 43 (step S412). In this way, the purge operation 503 is completed, and the vapor-phase gas G generated in the fuel tank 62 is used for the combustion operation of the internal combustion engine 61.

(RELATIONSHIP MAP M1 UPDATE AND THE LIKE)

In the present embodiment, the flowcharts (FIGS. 10 to 15) are shown in which the operations 501 to 504 by the control device 5 are performed separately. It is noted that, the present disclosure is not limited thereto. The learning operation 504 is not limited to being performed only prior to the vapor operation 501, the canister purge operation 502, and the purge operation 503. For example, the learning operation 504 may be continuously performed, including after the operations 501, 502, and 503 are performed. The learning operation 504 may be performed at an appropriate timing during the sealing operation of the control device 5 in which the fuel tank 62 is sealed by the sealing valve 3. In addition, the learning operation 504 may be performed between the vapor operation 501 and the canister purge operation 502, between the canister purge operation 502 and the purge operation 503, and between the purge operation 503 and the vapor operation 501.

Further, the vapor operations 501 or the purge operation 503 may be performed before the relationship map M1 is created by the learning operation 504. In this case, the opening degree correction unit 55 may temporarily use a predefined relationship map initially set in the control device 5. Then, after the relationship map M1 is generated by a subsequent learning operation 504, the created relationship map M1 can be used. The relationship map M1 may be appropriately updated each time the learning operation 504 is performed.

(OPERATION EFFECT)

The evaporative fuel processing device 1 of the present embodiment enables to learn the valve opening start amount K0, regardless of the environment in which the fuel tank 62 is provided, when the stepping motor 35 is operated, and the sealing valve 3 actually opens the purge pipe 41. This configuration enables to increase the learning opportunity and to enable to correct the opening degree command amount K1 for determining the opening degree of the sealing valve 3 appropriately by using the learning result. Further, the configuration enables to learn the relationship between the multiple values of the valve opening start amount K0 and the multiple values of the tank-side pressure P1, thereby to enable to create the relationship map M1.

Therefore, the evaporative fuel processing device 1 of the present embodiment enables to control the sealing valve 3 at the target opening degree in the vapor operation 501 and the purge operation 503, thereby to enable to control the purge flow rate of the evaporated fuel F1 from the fuel tank 62 more appropriately and quantitatively when the evaporated fuel F1 is purged to the canister 2 and the intake pipe 611.

Second Embodiment

The evaporative fuel processing device 1 of the present embodiment is configured to perform learning by the valve opening start learning unit 52 by utilizing the pressure difference ΔP that is formed when the leak check operation is performed by the leak check module 70. The basic configuration and basic operation of the evaporative fuel processing device 1 are the same as those in the first embodiment, and the differences will be mainly described below.

Incidentally, among reference numerals used in the second and subsequent embodiments, the same reference numerals as those used in the embodiment already described represent the same components as those in the embodiment already described, unless otherwise indicated.

In the first embodiment described above, the configuration forms the pressure difference ΔP by using the pump 71 of the leak check module 70 when performing the learning motion 504 in the normal state of the evaporative fuel treatment device 1, while the opening of the sealing valve 3 is zero. It is noted that, the configuration is not limited to that configuration. Even in a state in which the predetermined pressure difference ΔP is formed in the leak check operation by using the leak check module 70, an operation to open the vapor pipe 41 by the sealing valve 3 may be performed continuously in the state where the vapor pipe 41 is closed. In this way, the valve opening start position at that time may be learned in the same manner.

(LEAK CHECK OPERATION)

Figure 16:
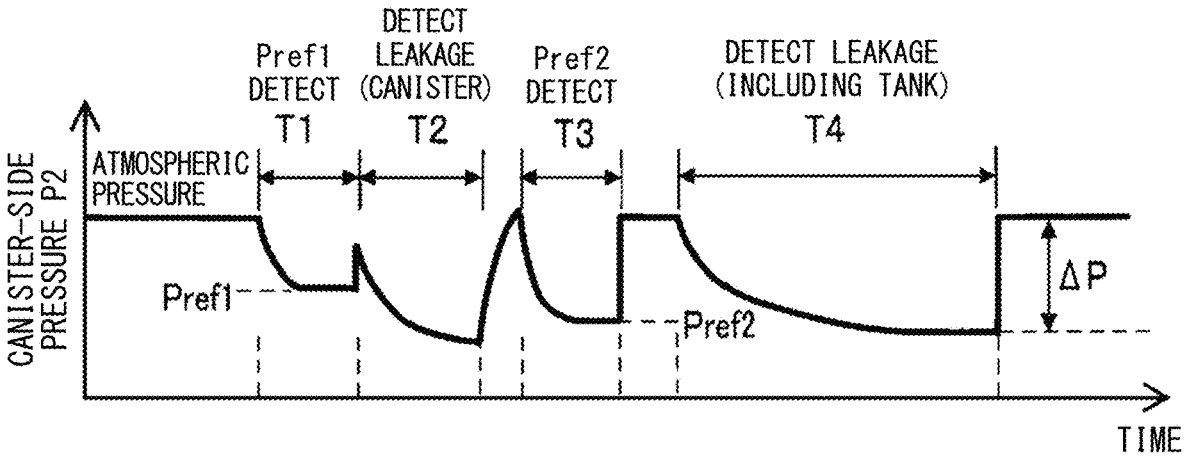
FIG. 16 is a flowchart showing a leak check operation of a leak check module used for the learning operation according to a second embodiment.

As shown in FIG. 16, in the leak check operation by using the leak check module 70, the switching valve 73 of the leak check module 70 and the sealing valve 3 are opened and closed in a timely manner, thereby to change the tank-side pressure P1 and the canister-side pressure P2, and thereby to form the pressure difference ΔP. The valve opening start learning unit 52 is enabled to learn the valve opening start position by using the pressure difference ΔP formed at that time during or after the leak check operation.

Specifically, the leak check operation is performed in a state where the internal combustion engine 61 is stopped, and first, a reference pressure Pref is detected by using the orifice passage 74 in the first section T1. At this time, as shown in FIG. 5, in the state where the switching valve 73 (open/close valve 23) is at the first position and is in the open state, the pump 71, which is a negative pressure pump, is driven, and the canister-side pressure P2 detected by using the canister-side pressure sensor 72 decreases to the reference pressure Pref1. The sealing valve 3 and the purge valve 43 are in the closed state.

Next, in the second section T2 of FIG. 16, presence or absence of leak in the evaporated fuel flow path including the canister 2 is determined (leakage detection). When the switching valve 73 (open/close valve 23) is switched to the second position in the closed state while the pump 71 driven, the canister-side pressure P2 increases once, and the negative pressure is introduced into the canister 2. As a result, the canister-side pressure P2 decreases again. At this time, when the canister-side pressure P2 becomes the reference pressure Pref1 or less, it may be determined that there is no leakage in the evaporated fuel flow path. As shown by the dotted line in the drawing, when the canister-side pressure P2 remains higher than the reference pressure Pref1, it may be determined that there is a leak.

Subsequently, the purge valve 43 is opened, thereby to communicate the evaporated fuel flow path including the canister 2 with the intake pipe 611 to introduce the atmosphere. Then, the canister-side pressure P2 increases to the atmospheric pressure. Subsequently, in the third section T3 of FIG. 16, the detection of the reference pressure Pref by using the orifice passage 74 is performed again in the same manner as in the first section T1. In this way, the canister-side pressure P2 decreases to the reference pressure Pref2.

Then, the pump 71 is stopped in this state, and the canister-side pressure P2 increases to the atmospheric pressure. Further, in the fourth section T4 of FIG. 16, presence or absence of leak in the evaporated fuel flow path including the fuel tank 62 and the canister 2 is detected. In this case, the sealing valve 3 is opened, the switching valve 73 and the purge valve 43 are closed, and the pump 71 is driven again. In this way, negative pressure is introduced into the evaporated fuel flow path including the fuel tank 62 and the canister 2, and the canister-side pressure P2 decreases again. At this time, when the canister-side pressure P2 becomes the reference pressure Pref2 or less, it may be determined that there is no leakage in the evaporated fuel flow path. As shown by the dotted line in the drawing, when the canister-side pressure P2 remains higher than the reference pressure Pref2, it may be determined that there is a leak.

Subsequently, the switching valve 73 is opened and the sealing valve 3 is closed, thereby to maintain the canister-side pressure P2 and the tank-side pressure P1 in the negative pressure state. Further, when the drive of the pump 71 is stopped, the canister-side pressure P2 increases to the atmospheric pressure, and the series of leak check operation is completed.

Figure 17:
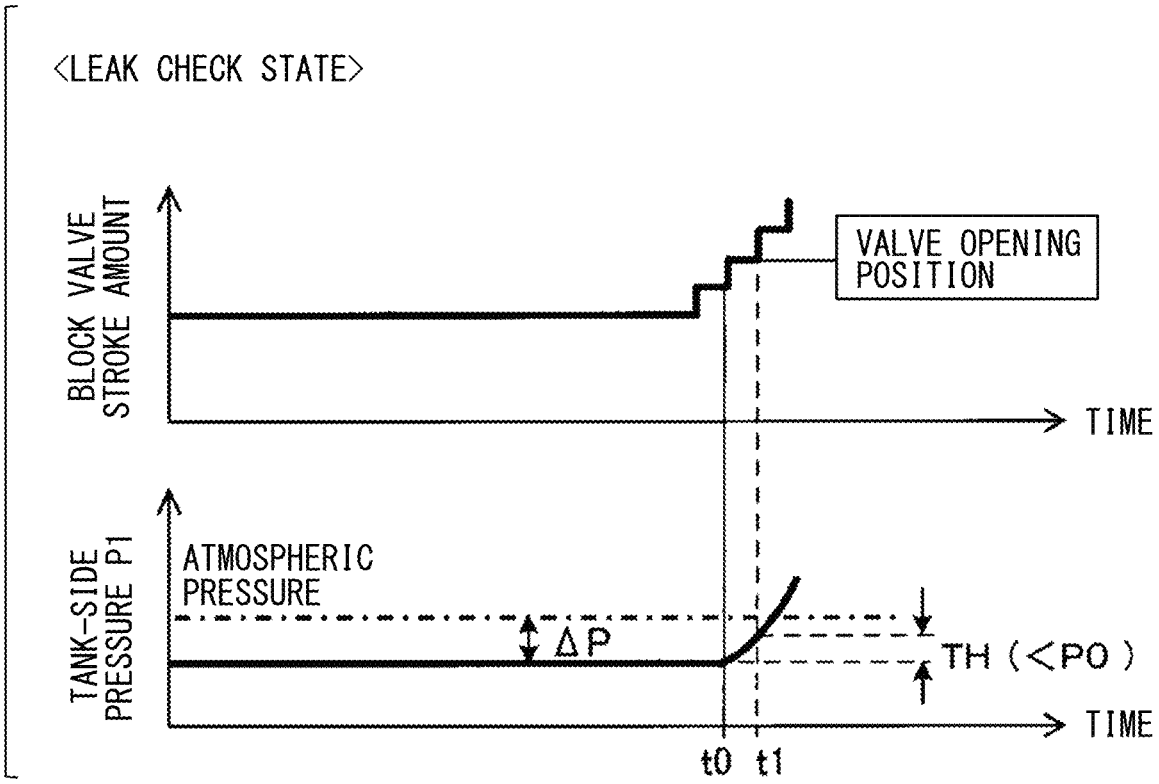
FIG. 17 is a timechart showing a learning operation performed during a leak check operation of the leak check module according to the second embodiment.

At the end of this series of leak check operation, the canister-side pressure P2 becomes the atmospheric pressure, and the tank-side pressure P1 becomes negative pressure. Therefore, as shown in FIG. 17, the learning operation 504 by the valve opening start learning unit 52 can be subsequently performed by using the pressure difference ΔP in this state. In this case, the tank-side pressure P1 increases, and the pressure change amount ΔP1 becomes equal to or higher than the valve opening threshold TH at the time point t1, and thereby, learning of the valve opening start amount K0 is enabled.

In addition, not only at the time of the completion, in the third section T2 of FIG. 16, after the leak check of the evaporated fuel flow path including the canister 2, the canister-side pressure P2 is a negative pressure, and the pressure difference ΔP with respect to the tank-side pressure P1 is formed in the state where the sealing valve 3 is closed. Therefore, the learning operation 504 by the valve opening start learning unit 52 may be performed by using the pressure difference ΔP in this state, and then, the leak check operation may be continuously performed.

According to this embodiment, the configuration enables to further increase the opportunity of the learning by utilizing the pressure difference ΔP formed by the leak check operation. Therefore, the configuration enables to control the sealing valve 3 at the target opening degree in the vapor operation 501 and the purge operation 503, thereby to enable to control the purge flow rate of the evaporated fuel F1 from the fuel tank 62 more appropriately and quantitatively when the evaporated fuel F1 is purged to the canister 2 and the intake pipe 611.

In the above-described embodiment, the configuration where the pressure difference is formed by using the pump 71 attached to the leak check module 70 has been described. However, it is noted that, even in a configuration where the evaporative fuel processing device 1 does not include the leak check module 70, a pump 71 that is configured to change the canister-side pressure P2 may be provided to the canister 2, thereby to enable to produce the same effect. Further, the pump 71 may be a negative pressure pump or a positive pressure pump. Further, the pump 71 may be a pump configured to reverse the motor rotation direction thereby to change the pressure to both the negative pressure and the positive pressure.

The present disclosure is not limited to each embodiment, and it is possible to configure further different embodiments without departing from the gist of the present disclosure. Further, the present disclosure includes various modifications, modifications within the equivalence, and the like. Furthermore, the technical idea of the present disclosure further includes various combinations and various forms of constitutional elements that are derivable from the present disclosure.

The controllers and methods described in the present disclosure may be implemented by a special purpose computer created by configuring a memory and a processor programmed to execute one or more particular functions embodied in computer programs. Alternatively, the controllers and methods described in the present disclosure may be implemented by a special purpose computer created by configuring a processor provided by one or more special purpose hardware logic circuits. Alternatively, the controllers and methods described in the present disclosure may be implemented by one or more special purpose computers created by configuring a combination of a memory and a processor programmed to execute one or more particular functions and a processor provided by one or more hardware logic circuits. The computer programs may be stored, as instructions being executed by a computer, in a tangible non-transitory computer-readable medium.

It should be appreciated that while the processes of the embodiments of the present disclosure have been described herein as including a specific sequence of steps, further alternative embodiments including various other sequences of these steps and/or additional steps not disclosed herein are intended to be within the steps of the present disclosure.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. An evaporated fuel processing device provided in a vehicle, which includes an internal combustion engine and a fuel tank, for processing evaporated fuel that is fuel evaporated in the fuel tank, comprising:

a canister including an adsorbent for adsorbing evaporated fuel;

a sealing valve provided in a vapor pipe that connects the fuel tank to the canister, the sealing valve configured to be operated by an actuator to quantitatively adjust an opening degree of the sealing valve to open and close the vapor pipe;

a tank pressure sensor provided in the fuel tank and configured to detect a tank-side pressure that is a pressure of vapor-phase phase gas in the fuel tank;

a purge valve provided in a purge pipe that connects the canister to an intake pipe of the internal combustion engine, the purge valve configured to open and close the purge pipe;

a control device configured to selectively execute each of a sealing operation to cause the sealing valve to close the vapor pipe to seal the fuel tank, a vapor operation to cause the sealing valve to open the vapor pipe to purge the vapor-phase gas in the fuel tank into the canister, a canister purge operation to cause the purge valve to open the purge pipe to purge a fuel component in the canister into the intake pipe, a purge operation to cause the sealing valve to open the vapor pipe and at the same time to cause the purge valve to open the purge pipe to purge the vapor-phase gas in the fuel tank into the intake pipe by bypassing the canister, and a learning operation to learn an opening degree of the sealing valve when the vapor pipe is opened;

an open/close valve configured to open and close a pressure release port that is configured to open the canister to an atmosphere; and a pressure variable device provided to the canister and configured to operate, while the open/close valve is closed, to variably adjust a canister-side pressure that is a pressure in the vapor pipe on a side of the canister with respect to the sealing valve, wherein the control device includes an opening degree command unit configured to transmit an opening degree command amount, which is for determining the opening degree of the sealing valve, to the actuator, a valve opening start learning unit configured to set a pressure difference between the tank-side pressure and the canister-side pressure to a specified value or more before opening the vapor pipe in the learning operation and learn a valve opening start amount based on the opening degree command amount when the tank-side pressure changes in response to the opening degree command amount that gradually increases from zero, and a pressure difference forming unit configured to cause the pressure variable device to change the canister-side pressure and control opening and closing of the open/close valve and the sealing valve to form a state in which the pressure difference becomes equal to or higher than a specified value in a state in which the sealing valve is closed, wherein the control device is configured to determine the opening degree command amount of the opening degree command unit based on the valve opening start amount, which has been learned, when causing the sealing valve to open to perform the vapor operation or the purge operation.

2. The evaporative fuel processing device according to claim 1, wherein the control device is configured to cause the pressure difference forming unit to form a state, in which the pressure difference is equal to or greater than the specified value, when the pressure difference is less than or is estimated to be less than the specified value, in the learning operation of the valve opening start learning unit.

3. The evaporative fuel processing device according to claim 1, wherein the pressure variable device includes a pump configured to change the canister-side pressure to a negative pressure or to a positive pressure, and the pressure difference forming unit is configured to cause the pressure variable device to change the canister-side pressure to a negative pressure or to a positive pressure to form the pressure difference, while the sealing valve is closed.

4. The evaporative fuel processing device according to claim 1, wherein the pressure variable device includes a pump configured to change the canister-side pressure to a negative pressure or to a positive pressure, the pressure difference forming unit is configured to cause the pressure variable device to change the canister-side pressure and the tank-side pressure to a negative pressure or to a positive pressure, while the sealing valve is opened, and subsequently, to close the sealing valve to maintain the tank-side pressure and to open the open/close valve to release the canister-side pressure to the atmosphere to form the pressure difference.

5. The evaporative fuel processing device according to claim 3, wherein the control device is configured to cause the pressure difference forming unit to form a state in which the tank-side pressure is higher than the canister-side pressure and cause the valve opening start learning unit to perform the learning operation to learn the valve opening start amount when the tank-side pressure starts to decrease.

6. The evaporative fuel processing device according to claim 3, wherein the control device is configured to cause the pressure difference forming unit to form a state in which the tank-side pressure is lower than the canister-side pressure and cause the valve opening start learning unit to perform the learning operation to learn the valve opening start amount when the tank-side pressure starts to increase.

7. The evaporative fuel processing device according to claim 1, wherein the pressure variable device is provided to a leak diagnostic device that is configured to diagnose presence or absence of leak of the evaporated fuel in a evaporated fuel flow path that passes from the fuel tank through the vapor pipe, the canister, and the purge pipe to the intake pipe, and the pressure difference forming unit is configured to form the pressure difference by using pressure formed in the evaporated fuel flow path in a leak check operation of the leak diagnostic device.

8. The evaporative fuel processing device according to claim 1, wherein the control device includes a relationship learning unit configured to learn a relationship between the tank-side pressure and the valve opening start amount in the learning operation when the valve opening start learning unit learns a plurality of different values of the valve opening start amount corresponding to a plurality of different values of the tank-side pressure and create a relationship map between the valve opening start amount and the tank-side pressure and an opening degree correction unit configured to collate an in-operation pressure, which is a pressure of the vapor-phase gas detected by using the tank pressure sensor, with the relationship map, when the sealing valve is opened to perform the vapor operation or the purge operation, and read an in-operation valve opening start amount, which is the valve opening start amount at this time, and correct the opening degree command amount of the opening degree command unit by using the in-operation valve opening start amount.

9. A control device for an evaporated fuel processing device provided in a vehicle, comprising:

a processor configured to selectively execute each of:

a sealing operation to cause an actuator to drive a sealing valve, which is provided in a vapor pipe connecting a fuel tank to a canister, to close the vapor pipe to seal the fuel tank, the canister including an adsorbent for adsorbing evaporated fuel, the actuator being configured to drive the sealing valve to quantitatively adjust an opening degree of the sealing valve for opening and closing the vapor pipe;

a vapor operation to cause the sealing valve to open the vapor pipe to purge vapor-phase gas in the fuel tank into the canister;

a canister purge operation to cause a purge valve, which is provided in a purge pipe connecting the canister to an intake pipe of an internal combustion engine, to open the purge pipe to purge a fuel component in the canister into the intake pipe;

a purge operation to cause the sealing valve to open the vapor pipe and at the same time to cause the purge valve to open the purge pipe to purge vapor-phase gas in the fuel tank into the intake pipe by bypassing the canister; and a learning operation to learn the opening degree of the sealing valve when the vapor pipe is opened, wherein the processor is further configured to:

transmit an opening degree command amount to the actuator to command the opening degree of the sealing valve;

set a pressure difference between a tank-side pressure, which is a pressure of the vapor-phase phase gas in the fuel tank, and a canister-side pressure, which is a pressure in the vapor pipe on a side of the canister with respect to the sealing valve, to a specified value or more in the learning operation before opening the vapor pipe and learn a valve opening start amount based on the opening degree command amount when the tank-side pressure changes in response to the opening degree command amount that gradually increases from zero;

cause a pressure variable device, which is provided to the canister, to variably adjust the canister-side pressure, control opening and closing of an open/close valve to control communication of the canister with an atmosphere, and control the sealing valve to form a state in which the pressure difference becomes equal to or higher than the specified value in a state in which the sealing valve is closed; and determine the opening degree command amount of the opening degree command unit based on the valve opening start amount, which has been learned, when causing the sealing valve to open to perform the vapor operation or the purge operation.

* * * * *